US010946228B2

(12) United States Patent
Kataoka

(10) Patent No.: US 10,946,228 B2
(45) Date of Patent: Mar. 16, 2021

(54) FIRE-EXTINGUISHING LIQUID AGENT AND FIRE-EXTINGUISHING EQUIPMENT LOADED WITH SAID FIRE-EXTINGUISHING LIQUID AGENT

(71) Applicants: EBIS RESEARCH INSTITUTE CO., LTD., Tokyo (JP); Toshiyo Sakurai, Chiba (JP); Toshiyuki Kataoka, Tokyo (JP)

(72) Inventor: Toshiyuki Kataoka, Tokyo (JP)

(73) Assignee: FF TECHNOLOGIES INC., San Diego, CA (US)

( * ) Notice: Subject to any disclaimer, the term of this patent is extended or adjusted under 35 U.S.C. 154(b) by 53 days.

(21) Appl. No.: 16/324,219

(22) PCT Filed: Aug. 10, 2016

(86) PCT No.: PCT/JP2016/073590
§ 371 (c)(1),
(2) Date: Feb. 8, 2019

(87) PCT Pub. No.: WO2018/029815
PCT Pub. Date: Feb. 15, 2018

(65) Prior Publication Data
US 2019/0168049 A1 Jun. 6, 2019

(51) Int. Cl.
*A62D 1/00* (2006.01)
*A62C 5/00* (2006.01)
*A62C 19/00* (2006.01)

(52) U.S. Cl.
CPC ..... *A62D 1/0042* (2013.01); *A62C 5/00* (2013.01); *A62D 1/0035* (2013.01); *A62C 19/00* (2013.01)

(58) Field of Classification Search
CPC ..... A62D 1/0042; A62D 1/0035; A62C 5/00; A62C 19/00
See application file for complete search history.

(56) References Cited

U.S. PATENT DOCUMENTS

2009/0242407 A1 10/2009 Shiga
2013/0146464 A1 6/2013 Shiga

FOREIGN PATENT DOCUMENTS

JP 8_257157 A 10/1996
JP 2007_020966 A 2/2007
(Continued)

OTHER PUBLICATIONS

Englosh Translation of JP 2012157589 (Year: 2012).*
International Search Report dated Nov. 1, 2016.

*Primary Examiner* — Andrew J. Oyer
(74) *Attorney, Agent, or Firm* — Bacon & Thomas, PLLC

(57) ABSTRACT

[Problem] To provide a fire-extinguishing liquid agent in which a fire-extinguishing agent is contained in a desirable balance and is satisfactorily dissolved in a solvent, that is easy to use, and that can be used against normal fires and oil fires, as well as fire-extinguishing equipment loaded with said fire-extinguishing liquid agent. [Solution] A fire-extinguishing liquid agent is sealed in an impact breakable container B that is molded by using a polystyrene resin material in which a general-purpose polystyrene and a styrene-butadiene copolymer are mixed and that has a hand-throwable size, wherein the fire-extinguishing liquid agent is formed: by containing 68-76 parts of sodium bicarbonate ($NaHCO_3$) relative to 100 parts by weight of ammonium chloride ($NH_4Cl$); by being treated by passing through a magnetic field having a magnetic flux density of 3000-10000 G; by being dissolved in hot water (magnetic water) in which the temperature thereof is adjusted to 30-50° C.; and by being adjusted to have a pH in a range of 7.5-10.

16 Claims, 6 Drawing Sheets

(56) References Cited

FOREIGN PATENT DOCUMENTS

| | | | |
|---|---|---|---|
| JP | 2008_6433 | A | 1/2008 |
| JP | 2010_119754 | A | 6/2010 |
| JP | 2012_157589 | A | 8/2012 |
| WO | WO2012_020825 | A1 | 2/2012 |

* cited by examiner

FIRE-EXTINGUISHING LIQUID AGENT AND FIRE-EXTINGUISHING EQUIPMENT LOADED WITH SAID FIRE-EXTINGUISHING LIQUID AGENT

TECHNICAL FIELD

The present invention relates to a fire-extinguishing liquid agent. More specifically, the present invention relates to a fire-extinguishing liquid agent, which can be used for normal fires (class A fires) and oil fires (class B fires) classified according to the fire service act and is of a type extinguishing fires by being thrown into fire sources, and fire-extinguishing equipment loaded with the fire-extinguishing liquid agent.

BACKGROUND ART

As fire-extinguishing equipment effective for extinguishing early stage fires, generally, a fire extinguisher is well known. Recently, the fire extinguisher has been increasingly installed in private homes in many cases, and a powder fire extinguisher and a foam fire extinguisher have become widespread. However, because these extinguishers are made of steel, they have problems of being heavy and bulky and becoming encumbrances in ordinary lives. Furthermore, because the operation for ejecting the fire-extinguishing liquid agent is complicated, poor handleability of these fire extinguishers is also a problem.

In addition, because perfluorooctane-1-sulfonate (PFOS) contained in the fire-extinguishing agent of the foam fire extinguisher is poorly degradable, persistence of the compound in the environment and the influence of the compound on the human health are regarded as issues. Therefore, the foam fire extinguisher is under international regulations due to the problem of environmental pollution.

Moreover, the powder fire extinguisher merely has an inhibitory action of inhibiting a combustion reaction and does not have a fire recurrence-preventing action of cutting off the supply of air to the fire source (burning material) or cooling the fire source such that the fire source does not easily burn. The powder fire extinguisher also has a problem of allowing fire, which is temporarily suppressed, to easily start again.

As extinguishers used for early stage fires, a water bucket, a fire-extinguishing water tank, dry sand, and the like have been traditionally used. According to the fire service act and the relevant government ordinance, these can be replaced with a fire extinguisher and are called "simple fire-extinguishing equipment". Among fire extinguishers handled as the simple fire-extinguishing equipment, there is a hand grenade fire extinguisher.

The hand grenade fire extinguisher is obtained by preparing an aqueous solution obtained by mixing together sodium chloride, ammonium bicarbonate, and the like as a fire-extinguishing liquid agent and sealing the agent into an impact breakable container. At the time of using the hand grenade fire extinguisher as simple fire-extinguishing equipment, the impact breakable container is directly thrown into a fire source such that the fire-extinguishing liquid agent is sprayed onto the fire source (burning material) from the broken container. The sprayed fire-extinguishing liquid agent is heated, causes a chemical reaction, generates ammonia gas ($NH_3$) and carbon dioxide ($CO_2$), and cuts off air supplied to the fire source (burning material), thereby extinguishing the fire.

For oil fires, a fire-extinguishing liquid agent supplemented with a surfactant can be used in some cases. In a case where the fire-extinguishing liquid agent supplemented with a surfactant is sprayed onto a fire source, the burning material is covered with flame retardant foams having high viscosity. As a result, the burning material remains asphyxiated by being cut off from contact with air, and fire recurrence is prevented (see PTL 1).

The fire-extinguishing action caused by the fire-extinguishing liquid agent is realized by the aforementioned chemical reaction. Therefore, the larger the amount of the agent relating to fire extinguishment dissolved in the aqueous solution, the more advantageous. However, sometimes the agent is precipitated in the fire-extinguishing liquid agent, becomes a sediment, and is not dissolved. Accordingly, it is still necessary to develop a fire-extinguishing liquid agent which can more efficiently extinguish fires.

In the present invention, an impact breakable container refers to a container having a property of being easily destroyed (easily broken) by impact of collision in a case where the container is thrown into a fire source.

CITATION LIST

Patent Literature

[PTL 1] Japanese Unexamined Patent Application Publication No. 2007-20966

SUMMARY OF INVENTION

Technical Problem

An object of the present invention is to provide a fire-extinguishing liquid agent, in which a fire-extinguishing agent is excellently dissolved in a good balance and which can efficiently extinguish normal fires or oil fires, and fire-extinguishing equipment loaded with the fire-extinguishing liquid agent.

Solution to Problem

A first invention that has been made to accomplish the aforementioned object is a fire-extinguishing liquid agent including a fire-extinguishing agent containing ammonium chloride and potassium carbonate, in which a content of the potassium carbonate is 68 to 76 parts with respect to 100 parts by weight of the ammonium chloride, and the fire-extinguishing liquid agent is obtained by dissolving the fire-extinguishing agent in hot water which is treated by passing through a magnetic field having a magnetic flux density of 3,000 to 10,000 G and has a temperature of 30° C. to 50° C.

As a second invention, a fire-extinguishing liquid agent is adopted in some cases which includes a fire-extinguishing agent containing ammonium chloride, potassium carbonate, ammonium phosphate dibasic, and sodium bicarbonate, in which a content of the potassium carbonate is 61 to 68 parts, a content of the ammonium phosphate dibasic is 19 to 22 parts, and a content of the sodium bicarbonate is 11 to 13 parts, with respect to 100 parts by weight of the ammonium chloride, and the fire-extinguishing liquid agent is obtained by dissolving the fire-extinguishing agent in hot water which is treated by passing through a magnetic field having a magnetic flux density of 3,000 to 10,000 G and has a temperature of 30° C. to 50° C.

A third invention may be a fire-extinguishing liquid agent including a fire-extinguishing agent containing ammonium chloride and sodium bicarbonate, in which a content of the sodium bicarbonate is 68 to 76 parts with respect to 100 parts by weight of the ammonium chloride, and the fire-extinguishing liquid agent is obtained by dissolving the fire-extinguishing agent in hot water which is treated by passing through a magnetic field having a magnetic flux density of 3,000 to 10,000 G and has a temperature of 30° C. to 50° C., wherein a pH of the fire-extinguishing liquid agent is within a range of 7.5 to 10.

A fourth invention may be a fire-extinguishing liquid agent including a fire-extinguishing agent containing ammonium chloride, ammonium phosphate dibasic, and sodium bicarbonate, in which a content of the ammonium phosphate dibasic is 19 to 22 parts, and a content of the sodium bicarbonate is 71 to 81 parts, with respect to 100 parts by weight of the ammonium chloride, the fire-extinguishing liquid agent is obtained by dissolving the fire-extinguishing agent in hot water which is treated by passing through a magnetic field having a magnetic flux density of 3,000 to 10,000 G and has a temperature of 30° C. to 50° C., and a pH of the fire-extinguishing liquid agent is within a range of 7.5 to 10.

A fifth invention may be a fire-extinguishing liquid agent including the fire-extinguishing liquid agent of the first invention as a first fire-extinguishing liquid agent, in which the fire-extinguishing liquid agent is obtained by mixing the first fire-extinguishing liquid agent with a surfactant solution obtained by dissolving a surfactant in hot water which is treated by passing through a magnetic field having a magnetic flux density of 3,000 to 10,000 G and has a temperature of 30° C. to 50° C.

A sixth invention may be a fire-extinguishing liquid agent including the fire-extinguishing liquid agent of the second invention as a second fire-extinguishing liquid agent, in which the fire-extinguishing liquid agent is obtained by mixing the second fire-extinguishing liquid agent with a surfactant solution obtained by dissolving a surfactant in hot water which is treated by passing through a magnetic field having a magnetic flux density of 3,000 to 10,000 G and has a temperature of 30° C. to 50° C.

A seventh invention may be a fire-extinguishing liquid agent including the fire-extinguishing liquid agent of the third invention as a third fire-extinguishing liquid agent, wherein the fire-extinguishing liquid agent is obtained by mixing the third fire-extinguishing liquid agent with a surfactant solution obtained by dissolving a surfactant in hot water which is treated by passing through a magnetic field having a magnetic flux density of 3,000 to 10,000 G and has a temperature of 30° C. to 50° C.

An eighth invention is a fire-extinguishing liquid agent including the fire-extinguishing liquid agent described in the fourth invention as a fourth fire-extinguishing liquid agent, in which the fire-extinguishing liquid agent is obtained by mixing the fourth fire-extinguishing liquid agent with a surfactant solution obtained by dissolving a surfactant in hot water which is treated by passing through a magnetic field having a magnetic flux density of 3,000 to 10,000 G and has a temperature of 30° C. to 50° C.

A ninth invention may be a fire-extinguishing liquid agent including the surfactant in any of the fifth to eighth inventions that is obtained by mixing together one or more surfactants selected from sodium polyoxyethylene alkyl ether sulfate, sodium lauryl sulfate, and a polyoxyethylene lauryl ether salt.

A tenth invention may be a fire-extinguishing liquid agent including the surfactant in any of the fifth to eighth inventions that is obtained by mixing together one or more surfactants selected from a sodium salt of a β-naphthalene-sulfonic acid formalin condensate, a special polycarboxylic acid-type polymer surfactant, and a polyoxyethylene lauryl ether salt.

An eleventh invention may be fire-extinguishing equipment including the fire-extinguishing liquid agent in any of the first to eighth inventions and an impact breakable container which is formed by molding a polystyrene resin material obtained by mixing general-purpose polystyrene with a styrene-butadiene copolymer, in which the fire-extinguishing liquid agent is sealed into the impact breakable container, and the outer peripheral surface of the impact breakable container has angulated portions on which stress caused by impact is concentrated.

Advantageous Effects of Invention

According to the present invention, it is possible to provide a fire-extinguishing liquid agent in which a fire-extinguishing agent is excellently dissolved in a good balance and which can efficiently extinguish normal fires or oil fires.

DESCRIPTION OF EMBODIMENTS

Figure 1:
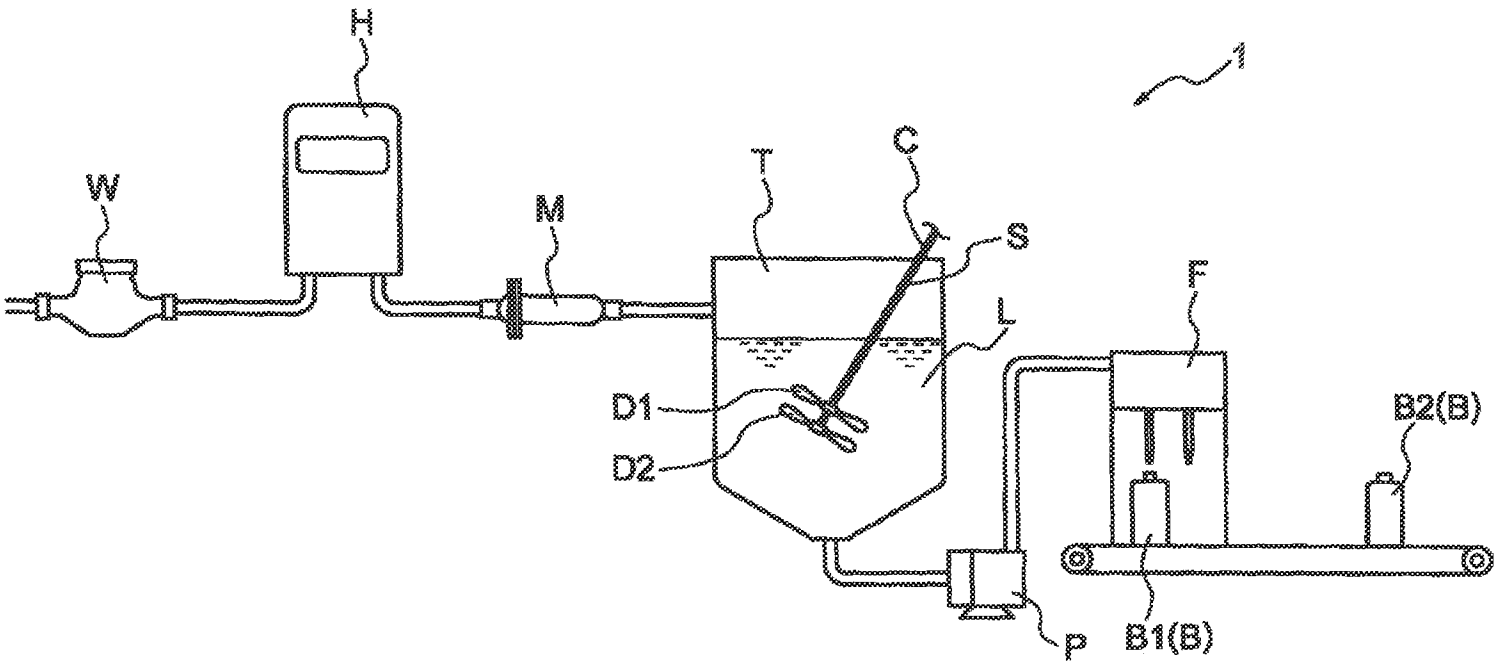
FIG. 1 is a schematic view of a fire-extinguishing liquid agent preparation apparatus for preparing a fire-extinguishing liquid agent.

The embodiments which will be described below are merely an embodiment of the present invention. The present invention is not limited thereto, and design change can be made within the scope of the present invention.

First Embodiment

In the present embodiment, a fire-extinguishing liquid agent is obtained by dissolving a fire-extinguishing agent including ammonium chloride and potassium carbonate in temperature-controlled hot water (magnetic water) having undergone a magnetic treatment.

The fire-extinguishing agent contains ammonium chloride ($NH_4Cl$) (main agent) and potassium carbonate ($KaCO_3$), in which the content of the potassium carbonate is 68 to 76 parts with respect to 100 parts by weight of the ammonium chloride. The fire-extinguishing agent is dissolved in hot water (magnetic water), which is subjected to temperature control in advance such that the temperature thereof becomes 30° C. to 50° C. and has undergone a magnetic treatment at a magnetic flux density of 3,000 G to 10,000 G, by being stirred for 1 hour, thereby preparing the fire-extinguishing liquid agent.

In a case where the temperature of the hot water (magnetic water) is lower than 30° C., the solubility of the fire-extinguishing agent (maximum amount of the fire-extinguishing agent dissolved in a solvent) that will be described later is reduced. In a case where the temperature of the hot water is higher than 50° C., the amount of the hot water (magnetic water), which is a solvent, evaporated increases, the fire-extinguishing agent is precipitated after being cooled, and hence the fire-extinguishing ability is reduced. Generally, the higher the water temperature, the higher the solubility of the agent. In the present embodiment, the temperature of the hot water is most preferably set to be 40° C.

During the magnetic treatment, a magnetic field having a magnetic flux density of 3,000 to 10,000 G is formed by a magnet, and the hot water passes through the magnetic field while swirling along a flow path created in the form of a helix in the vicinity of the outer periphery of the magnet. At this time, because the hot water crosses the lines of strong magnetic force, molecules of the hot water (water) undergo a segmentation treatment. The contact area of the hot water (magnetic water), which has undergone the segmentation treatment, with the agent increases, and accordingly, the agent is easily dissolved. Furthermore, because the high water temperature brings about a synergistic effect, larger amounts of the agent is dissolved, and even after the water is cooled, the dissolution state tends to be effectively maintained for a long period of time.

It is considered that the higher the magnetic flux density, the more effective. However, in a case where the magnetic flux density is higher than 20,000 G, the human body is likely to be affected by it. Therefore, in the present embodiment, the upper limit of the magnetic flux density is set to be 10,000 G. In a case where the magnetic flux density is lower than 3,000 G, the effect of the magnetic treatment performed on the hot water is reduced. Therefore, in the present embodiment, the magnetic treatment is most preferably performed at 7,800 G.

Accordingly, as long as the human body is unlikely to be affected by a high magnetic flux density (for example, as long as a shield structure for preventing lines of magnetic force from leaking to the outside is adopted), a case where a magnetic field having a magnetic flux density higher than 10,000 G (for example, 15,000 G or 20,000 G) is applied to the hot water is also included in the scope of the present invention.

In a case where the fire-extinguishing liquid agent prepared as above is thrown into a fire source (burning material), ammonium chloride and potassium carbonate react with each other and release ammonia gas ($NH_3$) and carbon dioxide ($CO_2$).

In a case where such a fire-extinguishing liquid agent is thrown into a fire source (burning material), ammonium chloride ($NH_4C$) and potassium carbonate ($K_2CO_3$) react with each other and release ammonia gas ($NH_3$) and carbon dioxide ($CO_2$), and as a result, potassium chloride (KCl) and water ($H_2O$) are generated.

$$2NH_4Cl+K_2CO_3 \rightarrow 2NH_3+CO_2+2KCl+H_2O$$

At this time, the ammonium chloride and the potassium carbonate are in an aqueous solution in which these compounds are thoroughly dissolved. Accordingly, the compounds are heated without burning and react rapidly.

Furthermore, at this time, water as the aqueous solution becomes water vapor. The ammonia gas, the carbon dioxide, and the water vapor inhibit burning by rapidly removing the air (oxygen) around the fire source (burning material), thereby extinguishing the fire.

In a case where the content of the potassium carbonate is smaller than 68 parts, a sufficient amount of gas will not be generated. Furthermore, in a case where the content of the potassium carbonate is larger than 76 parts, sometimes the compound remains as a solid content in the fire-extinguishing liquid agent without being thoroughly dissolved or becomes a sediment by being precipitated during the storage of the fire-extinguishing liquid agent. In the present embodiment, the content of the potassium carbonate is most preferably 72.21 parts.

One of the characteristics of ammonium chloride is that this compound is a substance admitted to be used as a food additive such as an expanding material or a flavor. The ammonium chloride used in the present invention is not particularly limited and can be selected from a wide variety of ammonium chlorides used for food additives or industrial uses.

Furthermore, one of the characteristics of potassium carbonate is that this compound is also a food additive used as bittern for Chinese noodle. The potassium carbonate used in the present invention is not particularly limited and can be selected from a wide variety of potassium carbonates used for food additives or industrial uses.

In this case, the fire-extinguishing liquid agent is prepared, for example, by a fire-extinguishing liquid agent preparation apparatus 1 schematically shown in FIG. 1.

The fire-extinguishing liquid agent preparation apparatus 1 includes a water supply portion W that supplies water which will become a solvent, a heating portion H that controls the temperature of the supplied water, a magnetic treatment portion M that performs a magnetic treatment on the temperature-controlled hot water, a dissolution treatment portion T that puts and dissolves a fire-extinguishing agent in the hot water (magnetic water) having undergone the magnetic treatment, a loading portion F that loads a bottle B with a solution (fire-extinguishing liquid agent) in which the agent is dissolved, and a pump P that pumps the solution (fire-extinguishing liquid agent) into the loading portion F from the dissolution treatment portion T.

The water supply portion W is connected to a water supply and supplies water to the fire-extinguishing liquid agent preparation apparatus 1 as necessary. The water supply portion W may be used in combination with a filter or a water purifier for removing impurities or compounds contained in the water supply.

The heating portion H performs temperature control such that the temperature becomes a water temperature (in the present embodiment, for example, 30° C. to 50° C.) required at the time of preparing the fire-extinguishing liquid agent. The heating method is not limited as long as the temperature of the water supplied to the fire-extinguishing liquid agent preparation apparatus 1 can be continuously controlled. For example, an electric heating method or a gas heating method may be used. The heating method may be appropriately selected according to the environment in which the fire-extinguishing liquid agent preparation apparatus 1 is installed.

In the magnetic treatment portion M, a plurality of magnets (ferrite magnets, neodymium-based magnets, Alnico magnets, samarium-based magnets, and the like) are arrayed in the form of rods at predetermined intervals. As a result, lines of strong magnetic force are radiated in a direction crossing the rod-like axis. The hot water whose temperature is controlled in the heating portion H crosses the lines of magnetic force while passing through a flow path provided in the form of a helix along the rod-like axis, and is affected by the lines of strong magnetic force. By being affected by the lines of strong magnetic force, the hot water (magnetic water) undergoes a segmentation treatment. Consequently, the hot water obtains properties of making it easy for the agent to be dissolved.

The dissolution treatment portion T is a tank storing the hot water (magnetic water) having undergone the magnetic treatment in the magnetic treatment portion M, and includes a stirrer C for performing stirring such that the fire-extinguishing agent put into the tank is dissolved and become an aqueous solution.

The stirrer C includes a long rod-like shaft S provided with two rows of propeller-like stirring bars (blades D1 and D2) spaced at a predetermined distance (for example, 30 to 40 cm) on the tip side thereof. The shaft S is obliquely inserted into the tank in a direction oblique to the vertical direction of the tank. In a case where the long rod-like shaft S rotates, the stirring bars (blades D1 and D2) rotate in the fire-extinguishing liquid agent L (water and the fire-extinguishing agent) in the tank. As a result, the fire-extinguishing liquid agent L is stirred, and the dissolution of the fire-extinguishing agent in the hot water (magnetic water) is accelerated.

Furthermore, because the long rod-like shaft S is inserted into the tank in a direction oblique to the vertical direction of the tank, a whirlpool (spiral flow) caused by stirring occurs in a direction oblique to the vertical direction of the tank. Therefore, the fire-extinguishing agent, which tends to stay at the bottom of the tank due to gravity, swirls by being caught in the whirlpool. As a result, the fire-extinguishing agent is dissolved in the hot water (magnetic water) with a higher efficiency.

In the present embodiment, a case is exemplified in which two propeller-like stirring bars (blades) D1 and D2 are provided on the tip side of the long rod-like shaft S. However, the number of stirring bars is not limited thereto, and may be increased or reduced as appropriate according to the required stirring ability.

Figure 2:
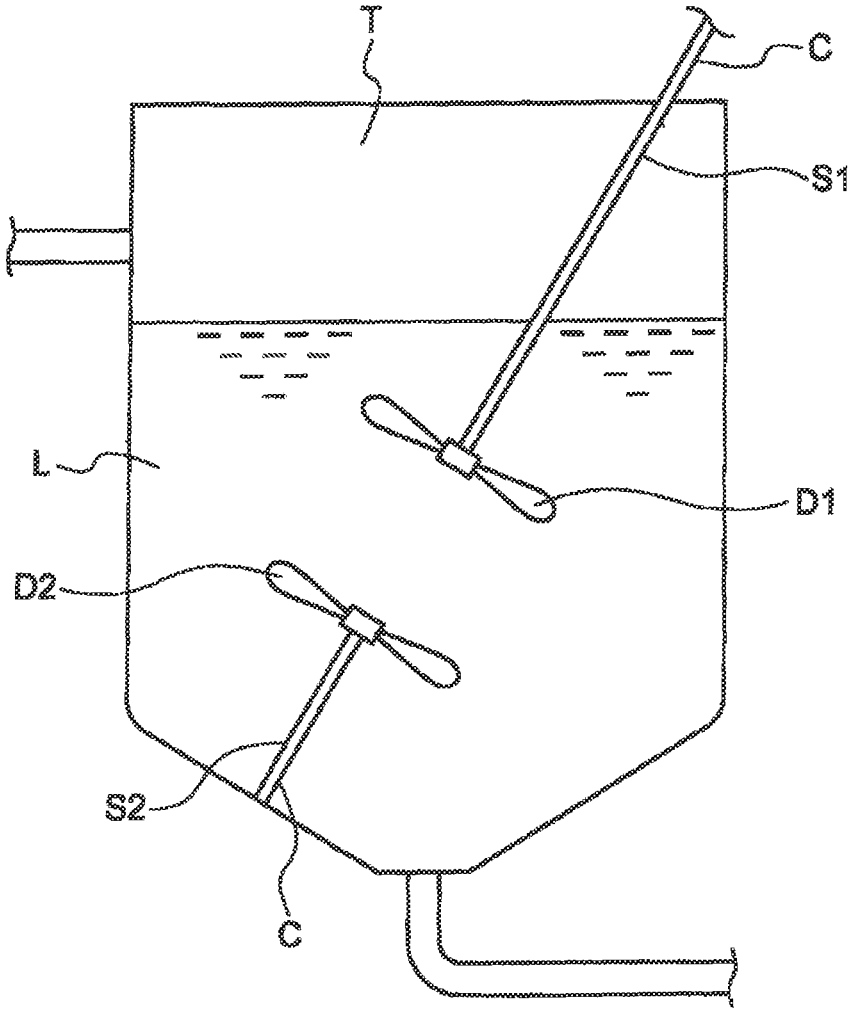
FIG. 2 is a view illustrating another example of a dissolution treatment portion of the fire-extinguishing liquid agent preparation apparatus.

Furthermore, as shown in FIG. 2, the dissolution treatment portion T may include a first long rod-like shaft S1, which is inserted into the tank from the top of the tank in a direction oblique to the vertical direction of the tank, and a second long rod-like shaft S2, which rises from the bottom of the tank and is positioned to matching with the axis of the first long rod-like shaft S1.

In this case, the propeller-like stirring bar (blade) D1 is provided on the tip side of the first long rod-like shaft S1, the propeller-like stirring bar (blade) D2 is provided on the tip side of the second long rod-like shaft S2, and two of the propeller-like stirring bars D1 and D2 are disposed to face each other. The propeller-like stirring bar (blade) D1 stirs the aqueous solution such that the fire-extinguishing agent is dissolved, and the propeller-like stirring bar (blade) D2 stirs the fire-extinguishing agent falling to the bottom side of the tank due to the action of gravity. Therefore, the fire-extinguishing agent is dissolved in the hot water (magnetic water) with a much higher efficiency.

The aqueous solution, which is prepared by thoroughly dissolving the fire-extinguishing agent in the hot water (magnetic water) in the dissolution treatment portion T, fills a bottle as the fire-extinguishing liquid agent L. The bottle may be filled by any method. In the present embodiment, for example, the loading portion F controls the pump P such that the fire-extinguishing liquid agent L is pumped into the loading portion F from the dissolution treatment portion T. In the loading portion F, the fire-extinguishing liquid agent L is injected into an empty bottle (impact breakable container) B1. As a result, a bottle B2 loaded with the fire-extinguishing liquid agent L and then sealed becomes a hand grenade fire extinguisher (simple fire-extinguishing equipment).

For example, in a method for preparing the fire-extinguishing liquid agent L by using the fire-extinguishing liquid agent preparation apparatus 1, water supplied from the water supply portion W is subjected to temperature control in the heating portion H such that the temperature thereof becomes 40° C., and is then sent to the magnetic treatment portion M. In the magnetic treatment portion M, the water undergoes a magnetic treatment by passing through a magnetic field having a magnetic flux density of 10,000 G, and 70 kg (70 L) of the obtained hot water (magnetic water) is stored in the dissolution treatment portion T. Then, a fire-extinguishing agent formed of 14.32 kg of ammonium chloride and 10.34 kg of potassium carbonate is put into the hot water (magnetic water) and dissolved by being stirred for 1 hour by two propeller-like stirring bars (blades) D1 and D2 obliquely installed in the tank of the dissolution treatment portion T. In this way, the fire-extinguishing liquid agent L can be prepared. In this case, the proportion of the hot water (magnetic water) is 35%, and the proportion of the fire-extinguishing agent dissolved in the hot water is 65%.

Table 1 shows the fire-extinguishing liquid agent L prepared using the fire-extinguishing liquid agent preparation apparatus 1, a fire-extinguishing liquid agent (Comparative Example 1) prepared using a fire-extinguishing liquid agent preparation apparatus in which the magnetic treatment portion M is substituted with a resonant wave-type magnetic device, a fire-extinguishing liquid agent (Comparative Example 2) prepared using a fire-extinguishing liquid agent preparation apparatus in which the magnetic treatment portion M is substituted with an electrostatic field-type magnetic device, and results obtained by measuring zeta potential of these immediately after the preparation, after 1 week, and after 2 weeks.

TABLE 1

Comparative table of zeta potential of a fire-extinguishing liquid agent prepared using a fire-extinguishing liquid agent preparation apparatus in FIG. 1

| | Immediately after the preparation | After 1 week | After 2 weeks | Average amount of adhesion at test |
|---|---|---|---|---|
| The present invention | −18.8 (mv) | −17.6 (mv) | −17.2 (mv) | 770 mg/cm2 |
| Comparative Example 1 a resonant wave-type magnetic device | −18.4 (mv) | −14.3 (mv) | −17.2 (mv) | 1,140 mg/cm2 |
| Comparative Example 2 an electrostatic field-type magnetic device | −22.2 (mv) | −9.2 (mv) | −4.1 (mv) | 1,420 mg/cm2 |

In the present embodiment, as described above, the fire-extinguishing agent is dissolved in the hot water (magnetic water), which has undergone a magnetic treatment, while being stirred. Due to the magnetic treatment, the water molecules undergo a segmentation treatment, and accordingly, the contact area of the water with the agent increases. In addition, because the water is stirred at a high temperature, the number of times of contact between the water molecules and the agent increases, and the dissolution reaction is accelerated. Due to the synergistic effect of these, larger amounts of the agent can be dissolved. Furthermore, even after the water is cooled, the dissolution state tends to be maintained for a long period of time, and a high fire-extinguishing ability can be demonstrated.

Second Embodiment

In the present embodiment, a fire-extinguishing agent including ammonium chloride ($NH_4Cl$), potassium carbonate ($K_2CO_3$), ammonium phosphate dibasic ($(NH_4)_2HPO_4$), and sodium bicarbonate ($NaHCO_3$) is dissolved in temperature-controlled hot water (magnetic water) having undergone a magnetic treatment, thereby obtaining the fire-extinguishing liquid agent L.

The fire-extinguishing agent contains ammonium chloride (main agent), potassium carbonate, ammonium phosphate dibasic, and sodium bicarbonate, in which the content of the potassium carbonate is 61 to 68 parts, the content of the ammonium phosphate dibasic is 19 to 22 parts, and the content of the sodium bicarbonate is 11 to 13 parts with respect to 100 parts by weight of the ammonium chloride. The fire-extinguishing agent is dissolved in hot water (magnetic water), which is subjected to temperature control in advance such that the temperature thereof becomes 30° C. to 50° C. and has undergone a magnetic treatment at a magnetic flux density of 3,000 to 10,000 G in the magnetic treatment portion M, thereby obtaining the fire-extinguishing liquid agent L. The ammonium chloride, the potassium carbonate, the ammonium phosphate dibasic, and the sodium bicarbonate constituting the fire-extinguishing agent L are put in this order into the dissolution treatment portion T storing the hot water (magnetic water) and dissolved by being stirred for 1 hour in total.

The temperature control and the magnetic treatment for the hot water will not be described herein because they are the same as those in the first embodiment.

Similarly to the fire-extinguishing liquid agent L according to the first embodiment, the fire-extinguishing liquid agent L according to the present embodiment is prepared by the fire-extinguishing liquid agent preparation apparatus 1 schematically shown in FIG. 1. The fire-extinguishing agent according to the present embodiment is put into the hot water (magnetic water) having undergone a magnetic treatment, and dissolved by being stirred for 1 hour by two propeller-like stirring bars (blades) D1 and D2 obliquely installed in the tank of the dissolution treatment portion T, thereby obtaining the fire-extinguishing liquid agent L. Details of the process will not be described herein because they are the same as details of the process performed by the fire-extinguishing liquid agent preparation apparatus 1 according to the first embodiment.

In a case where the fire-extinguishing liquid agent L according to the present embodiment is thrown into a fire source (burning material), ammonium chloride ($NH_4Cl$) and potassium carbonate ($K_2Co_3$) react with each other and release ammonia gas ($NH_3$) and carbon dioxide ($CO_2$), and as a result, potassium chloride (KCl) and water ($H_2O$) are generated.

Furthermore, the ammonium phosphate dibasic added in the present embodiment is heated and releases ammonia gas, and the sodium bicarbonate releases carbon dioxide. These gases assist the fire-extinguishing action. In addition, by inhibiting the reaction between the ammonium chloride and the potassium carbonate at room temperature, the sodium bicarbonate also contributes to the long-term stabilization of the fire-extinguishing liquid agent.

In a case where the content of the potassium carbonate is smaller than 61 parts, the amount of the fire-extinguishing gas generated becomes insufficient. In a case where the content of the potassium carbonate is larger than 78 parts, the compound remains as a solid content in the fire-extinguishing liquid agent without being thoroughly dissolved or becomes a sediment by being precipitated during the storage of the fire-extinguishing liquid agent, and accordingly, the fire-extinguishing ability is reduced. In the present embodiment, the content of the potassium carbonate is most preferably 64.58 parts.

Furthermore, in a case where the content of the ammonium phosphate dibasic is smaller than 19 parts, the amount of the fire-extinguishing gas generated becomes insufficient. In a case where the content of the ammonium phosphate dibasic is larger than 22 parts, the compound remains as a solid content in the fire-extinguishing liquid agent without being thoroughly dissolved or becomes a sediment by being precipitated during the storage of the fire-extinguishing liquid agent, and accordingly, the fire-extinguishing ability is reduced.

In the present embodiment, the content of the ammonium phosphate dibasic is most preferably 20.54 parts.

In a case where the content of the sodium bicarbonate is smaller than 11 parts, the amount of the fire-extinguishing gas generated becomes insufficient. In a case where the content of the sodium bicarbonate is larger than 13 parts, the compound remains as a solid content in the fire-extinguishing liquid agent without being thoroughly dissolved or becomes a sediment by being precipitated during the storage of the fire-extinguishing liquid agent, and accordingly, the fire-extinguishing ability is reduced.

In the present embodiment, the content of the sodium bicarbonate is most preferably 11.9 parts.

Specifically, in the present embodiment, for example, 336 g of ammonium chloride is mixed with 217 g of potassium carbonate, 69 g of ammonium phosphate dibasic, and 11.9 g of sodium bicarbonate, and the mixture is dissolved in 1,000 g (1 L) of hot water (magnetic water), thereby obtaining 1633.9 g (1,225 L) of the fire-extinguishing liquid agent L.

In the present embodiment, as described above, the fire-extinguishing agent is also dissolved in the hot water (magnetic water), which has undergone a magnetic treatment, while being stirred. Due to the magnetic treatment, the water molecules undergo a segmentation treatment, and accordingly, the contact area of the water with the agent increases. In addition, because the water is stirred at a high temperature, the number of times of contact between the water molecules and the agent increases, and the dissolution reaction is accelerated. Due to the synergistic effect of these, larger amounts of the agent can be dissolved. Furthermore, even after the water is cooled, the dissolution state tends to be maintained for a long period of time, and a high fire-extinguishing ability can be demonstrated.

Third Embodiment

In the present embodiment, a fire-extinguishing agent including ammonium chloride and sodium bicarbonate is dissolved in temperature-controlled hot water (magnetic water) having undergone a magnetic treatment, thereby obtaining the fire-extinguishing liquid agent.

The fire-extinguishing agent contains ammonium chloride (main agent) and sodium bicarbonate, in which the content of the sodium bicarbonate is 68 to 76 parts with respect to 100 parts by weight of the ammonium chloride. The fire-extinguishing agent is put into the dissolution treatment portion T storing hot water (magnetic water), which is subjected to temperature control in advance such that the temperature thereof becomes 30° C. to 50° C. and has undergone a magnetic treatment at a magnetic flux density of 3,000 to 10,000 G in the magnetic treatment portion M, and dissolved by being stirred for 1 hour, thereby obtaining the fire-extinguishing liquid agent L.

The temperature control and the magnetic treatment for the hot water will not be described herein because they are the same as those in the first embodiment.

Similarly to the fire-extinguishing liquid agent L according to the first embodiment, the fire-extinguishing liquid agent L according to the present embodiment is prepared by the fire-extinguishing liquid agent preparation apparatus 1 schematically shown in FIG. 1. The fire-extinguishing agent according to the present embodiment is put into the hot water (magnetic water) having undergone a magnetic treatment, and dissolved by being stirred for 1 hour by two propeller-like stirring bars (blades) D1 and D2 obliquely installed in the tank of the dissolution treatment portion T, thereby obtaining the fire-extinguishing liquid agent L. Details of the process will not be described herein because they are the same as details of the process performed by the fire-extinguishing liquid agent preparation apparatus 1 according to the first embodiment.

Both the sodium bicarbonate and the ammonium chloride are weakly alkaline. Therefore, the fire-extinguishing liquid agent of the present embodiment obtained by mixing together the compounds becomes weakly alkaline as well. Specifically, the fire-extinguishing liquid agent L is prepared such that the pH thereof falls into a range of 7.5 to 10. In a case where the pH is lower than 7.5, the odor of ammonia of the fire-extinguishing liquid agent becomes strong, and the fire-extinguishing liquid agent is stored in poor condition. In a case where the pH is higher than 10, because the alkalinity is high, the fire-extinguishing agent is not easily dissolved, and a sediment is generated at the bottom of the container during the long-term storage. In the present embodiment, the pH of the fire-extinguishing liquid agent is most preferably 8 to 9.

In a case where the fire-extinguishing liquid agent L according to the present embodiment is thrown into a fire source (burning material), ammonium chloride ($NH_4Cl$) and sodium bicarbonate ($NaHCO_3$) react with each other and release ammonia gas ($NH_3$) and carbon dioxide ($CO_2$). As a result, sodium chloride (NaCl) and water ($H_2O$) are generated.

$$NH_4Cl+NaHCO_3 \rightarrow NH_3+CO_2+NaCl+H_2O$$

At this time, the ammonium chloride and the sodium bicarbonate are in an aqueous solution in which these compounds are thoroughly dissolved. Accordingly, the compounds are heated without burning and react rapidly. Furthermore, at this time, water as the aqueous solution becomes water vapor. The ammonia gas, the carbon dioxide, and the water vapor inhibit burning by rapidly removing air (oxygen) around the fire source (burning material), thereby extinguishing the fire.

In a case where the content of the sodium bicarbonate is smaller than 68 parts, the amount of the fire-extinguishing gas generated becomes insufficient. In a case where the content of the sodium bicarbonate is larger than 76 parts, the compound remains as a solid content in the fire-extinguishing liquid agent without being thoroughly dissolved or becomes a sediment by being precipitated during the storage of the fire-extinguishing liquid agent. In the present embodiment, the content of the sodium bicarbonate is most preferably 72.21 parts.

Specifically, in the present embodiment, for example, 14.32 kg of ammonium chloride is mixed with 10.34 kg of sodium bicarbonate, and the mixture is dissolved in 82 kg (82 L) of hot water (magnetic water), thereby obtaining 100 kg (100 L) of the fire-extinguishing liquid agent L.

One of the characteristics of ammonium phosphate dibasic is that this compound is a substance admitted to be used as a food-processing material such as a chemical for brewing. The ammonium phosphate dibasic used in the present invention is not particularly limited and can be selected from a wide variety of ammonium phosphate dibasics used for food additives or industrial uses.

Furthermore, one of the characteristics of sodium bicarbonate is that this compound is also a food additive such as an expanding material. The sodium bicarbonate used in the present invention is not particularly limited and can be selected from a wide variety of sodium bicarbonates used for food additives or industrial uses.

In the present embodiment, as described above, the fire-extinguishing agent is dissolved in the hot water (magnetic water), which has undergone a magnetic treatment, while being stirred. Due to the magnetic treatment, the water molecules undergo a segmentation treatment, and accordingly, the contact area of the water with the agent increases. In addition, because the water is stirred at a high temperature, the number of times of contact between the water molecules and the agent increases, and the dissolution reaction is accelerated. Due to the synergistic effect of these, larger amounts of the agent can be dissolved. Furthermore, even after the water is cooled, the dissolution state tends to be maintained for a long period of time, and a high fire-extinguishing ability can be demonstrated.

Fourth Embodiment

In the present embodiment, a fire-extinguishing agent including ammonium chloride, ammonium phosphate dibasic, and sodium bicarbonate is dissolved in temperature-controlled hot water (magnetic water) having undergone a magnetic treatment, thereby obtaining a fire-extinguishing liquid agent.

The fire-extinguishing agent contains ammonium chloride, ammonium phosphate dibasic, and sodium bicarbonate, in which the content of the ammonium phosphate dibasic is 19 to 22 parts, and the content of the sodium bicarbonate is 71 to 81 parts, with respect to 100 parts by weight of the ammonium chloride (main agent). The fire-extinguishing agent is dissolved in hot water (magnetic water) which is subjected to temperature control in advance such that the temperature thereof becomes 30° C. to 50° C. and has undergone a magnetic treatment at a magnetic flux density of 3,000 to 10,000 G in the magnetic treatment portion M in the fire-extinguishing liquid agent L. The ammonium chloride, the ammonium phosphate dibasic, and the sodium bicarbonate constituting the fire-extinguishing agent are put in this order into the dissolution treatment portion T storing the hot water (magnetic water) and dissolved by being stirred for 1 hour in total.

The temperature control and the magnetic treatment for the hot water will not be described herein because they are the same as those in the first embodiment.

Similarly to the fire-extinguishing liquid agent L according to the first embodiment, the fire-extinguishing liquid agent L according to the present embodiment is prepared by the fire-extinguishing liquid agent preparation apparatus 1 schematically shown in FIG. 1. The fire-extinguishing agent according to the present embodiment is put into the hot water (magnetic water) having undergone a magnetic treatment, and dissolved by being stirred for 1 hour by two propeller-like stirring bars (blades) D1 and D2 obliquely installed in the tank of the dissolution treatment portion T, thereby obtaining the fire-extinguishing liquid agent L. Details of the process will not be described herein because they are the same as details of the process performed by the fire-extinguishing liquid agent preparation apparatus 1 according to the first embodiment.

Both the sodium bicarbonate and the ammonium chloride are weakly alkaline. Therefore, the fire-extinguishing liquid agent of the present embodiment obtained by mixing together the compounds becomes weakly alkaline as well. Specifically, the fire-extinguishing liquid agent L is prepared such that the pH thereof falls into a range of 7.5 to 10. In a case where the pH is lower than 7.5, the odor of ammonia of the fire-extinguishing liquid agent becomes strong, and the fire-extinguishing liquid agent is stored in poor condition. In a case where the pH is higher than 10, because the alkalinity is high, the fire-extinguishing agent is not easily dissolved, and a sediment is generated at the bottom of the container during the long-term storage. In the present embodiment, the pH of the fire-extinguishing liquid agent is most preferably 8 to 9.

In a case where the fire-extinguishing liquid agent according to the present embodiment is thrown into a fire source (burning material), because the ammonium chloride ($NH_4Cl$) and the sodium bicarbonate ($NaHCO_3$) are in an aqueous solution in which these compounds are thoroughly dissolved, the compounds are heated without burning, react rapidly, and generate ammonia gas, carbon dioxide, sodium chloride, and water. Furthermore, at this time, water as the aqueous solution becomes water vapor. The ammonia gas, the carbon dioxide, and the water vapor inhibit burning by rapidly removing the air (oxygen) around the fire source (burning material), thereby extinguishing the fire.

In addition, the ammonium phosphate dibasic added in the present embodiment releases ammonia gas by a heating reaction, and the sodium bicarbonate releases carbon dioxide. These gases assist the fire-extinguishing action. Moreover, by inhibiting the reaction between the ammonium chloride and the potassium carbonate at room temperature, the sodium bicarbonate also contributes to the long-term stabilization of the fire-extinguishing liquid agent.

Similarly to the fire-extinguishing liquid agent according to the first embodiment, the fire-extinguishing liquid agent L according to the present embodiment is prepared by the fire-extinguishing liquid agent preparation apparatus 1 schematically shown in FIG. 1. The fire-extinguishing agent according to the present embodiment is put into the hot water (magnetic water) having undergone a magnetic treatment, and dissolved by being stirred for 1 hour, thereby obtaining the fire-extinguishing liquid agent L. Details of the process will not be described herein because they are the same as details of the process performed by the fire-extinguishing liquid agent preparation apparatus 1 according to the first embodiment.

In a case where the content of the sodium bicarbonate is smaller than 71 parts, the amount of the fire-extinguishing gas generated becomes insufficient. In a case where the content of the sodium bicarbonate is larger than 80 parts, the compound remains as a solid content in the fire-extinguishing liquid agent without being thoroughly dissolved or becomes a sediment by being precipitated during the storage of the fire-extinguishing liquid agent, and accordingly, the fire-extinguishing ability is reduced. In the present embodiment, the content of the sodium bicarbonate is most preferably 76.49 parts.

Furthermore, in a case where the content of the ammonium phosphate dibasic is smaller than 19 parts, the amount of the fire-extinguishing gas generated becomes insufficient. In a case where the content of the ammonium phosphate dibasic is larger than 22 parts, the compound remains as a solid content in the fire-extinguishing liquid agent without being thoroughly dissolved or becomes a sediment by being precipitated during the storage of the fire-extinguishing liquid agent, and accordingly, the fire-extinguishing ability is reduced.

In the present embodiment, the content of the ammonium phosphate dibasic is most preferably 20.54 parts.

In a case where the content of the sodium bicarbonate is smaller than 11 parts, the amount of the fire-extinguishing gas generated becomes insufficient. In a case where the content of the sodium bicarbonate is larger than 13 parts, the compound remains as a solid content in the fire-extinguishing liquid agent without being thoroughly dissolved or becomes a sediment by being precipitated during the storage of the fire-extinguishing liquid agent, and accordingly, the fire-extinguishing ability is reduced.

In the present embodiment, the content of the sodium bicarbonate is most preferably 11.9 parts.

Specifically, in the present embodiment, for example, 336 g of ammonium chloride is mixed with 69 g of ammonium phosphate dibasic and 257 g of sodium bicarbonate, and the mixture is dissolved in 1,000 g (1 L) of hot water (magnetic water), thereby obtaining 1,662 g (1,225 L) of the fire-extinguishing liquid agent L.

In the present embodiment, as described above, the fire-extinguishing agent is also dissolved in the hot water (magnetic water), which has undergone a magnetic treatment, while being stirred. Due to the magnetic treatment, the water molecules undergo a segmentation treatment, and accordingly, the contact area of the water with the agent increases. In addition, because the water is stirred at a high temperature, the number of times of contact between the water molecules and the agent increases, and the dissolution reaction is accelerated. Due to the synergistic effect of these, larger amounts of the agent can be dissolved. Furthermore, even after the water is cooled, the dissolution state tends to be maintained for a long period of time, and a high fire-extinguishing ability can be demonstrated.

Fifth Embodiment

In the present embodiment, the fire-extinguishing liquid agent according to the first embodiment is used as a first fire-extinguishing liquid agent, and a surfactant solution is added to the first fire-extinguishing liquid agent, thereby obtaining the fire-extinguishing liquid agent L which can be used for extinguishing oil fires.

That is, similarly to the first embodiment, a fire-extinguishing agent including ammonium chloride and potassium carbonate is put into hot water (magnetic water), which is subjected to temperature control in advance such that the temperature thereof becomes 30° C. to 50° C. and has undergone a magnetic treatment at a magnetic flux density of 3,000 to 10,000 G in the magnetic treatment portion M. The fire-extinguishing agent is dissolved by being stirred for 1 hour by two propeller-like stirring bars (blades) D1 and D2 obliquely installed in the tank of the dissolution treatment portion T, thereby preparing the first fire-extinguishing liquid agent (A liquid). Furthermore, a surfactant is put into the dissolution treatment portion T storing the hot water (magnetic water), which is subjected to temperature control in advance such that the temperature thereof becomes 50° C. to 60° C. and has undergone a magnetic treatment at a magnetic flux density of 3,000 to 10,000 G in the same magnetic treatment portion M as that in the first embodiment. By using the same tank as that of the dissolution treatment portion T and two propeller-like stirring bars (blades) D1 and D2 which are obliquely installed, the surfactant is dissolved by being stirred for 30 minutes, thereby obtaining a surfactant solution (B liquid). The first fire-extinguishing liquid agent (A liquid) and the surfactant solution (B liquid) are mixed together and stirred, thereby obtaining the fire-extinguishing liquid agent L of the present embodiment.

The preparation of the first fire-extinguishing liquid agent (A liquid) will not be described herein because it is the same as the preparation of the first embodiment.

In a case where the temperature of the hot water (magnetic water) is lower than 50° C. at the time of preparing the surfactant solution (B liquid), the solubility of the surfactant (maximum amount of the surfactant dissolved in a solvent) is reduced. In a case where the temperature of the hot water is higher than 60° C., the amount of the hot water (magnetic water) as a solvent evaporated increases. Generally, the higher the water temperature, the higher the solubility of the surfactant. In the present embodiment, the temperature of the water is most preferably set to be 60° C.

The magnetic treatment will not be described herein because it is the same as the magnetic treatment in the first embodiment.

The surfactant solution which can be added to the fire-extinguishing liquid agent according to the present embodiment can be selected from a wide variety of surfactants. Particularly, it is preferable to select one or more surfactants from sodium polyoxyethylene alkyl ether sulfate as an anionic surfactant, sodium lauryl sulfate as an anionic surfactant, and a polyoxyethylene lauryl ether salt as a nonionic surfactant.

In this case, by regarding the amount of hot water (magnetic water), which is treated by passing through a magnetic field having a magnetic flux density of 3,000 to 10,000 G by using the same magnetic treatment portion M as that of the fire-extinguishing liquid agent preparation apparatus 1 of the first embodiment and subjected to temperature control such that the temperature thereof becomes 50° C. to 60° C., as being 100 parts by weight, 4.5 to 5.1 parts of the surfactant of sodium polyoxyethylene alkyl ether sulfate, 7.7 to 8.6 parts of the surfactant of sodium lauryl sulfate, and 9.6 to 10.6 parts of the surfactant of polyoxyethylene lauryl ether salt are mixed together and dissolved in the hot water by being stirred for 30 minutes by the dissolution treatment portion T which is the same as the magnetic treatment portion of the fire-extinguishing liquid agent preparation apparatus 1, thereby obtaining a surfactant solution (B liquid). B liquid is mixed with A liquid (first fire-extinguishing liquid agent) described above, thereby obtaining a fire-extinguishing liquid agent.

In a case where the content of the surfactant of sodium polyoxyethylene alkyl ether sulfate is smaller than 4.5 parts, the solute is not thoroughly dissolved and dispersed, and hence a sediment tends to occur. In a case where the content of the surfactant is larger than 5.1 parts, the surfactant molecules are aggregated. As a result, as the weight increases, the amount of active components decreases.

In a case where the content of the surfactant of sodium lauryl sulfate is smaller than 7.7 parts, the solute is not thoroughly dissolved and dispersed, and hence a sediment tends to occur. In a case where the content of the surfactant is larger than 8.6 parts, the surfactant molecules are aggregated. As a result, as the weight increases, the amount of active components decreases.

In a case where the content of the surfactant of the polyoxyethylene lauryl ether salt is smaller than 9.6 parts, the solute is not thoroughly dissolved and dispersed, and hence a sediment tends to occur. In a case where the content of the surfactant is larger than 10.6 parts, the surfactant molecules are aggregated. As a result, as the weight increases, the amount of active components decreases.

In the present embodiment, the proportion of the surfactant of sodium polyoxyethylene alkyl ether sulfate mixed in is most preferably 4.808 parts, the proportion of the surfactant of sodium lauryl sulfate mixed in is most preferably 8.173 parts, and the proportion of the surfactant of the polyoxyethylene lauryl ether salt mixed in is most preferably 10.096 parts.

Examples of usable commercial products of the surfactant of sodium polyoxyethylene alkyl ether sulfate include LATEMUL (registered trademark) from Kao Corporation, and the like. Examples of the surfactant of sodium lauryl sulfate include EMAL (registered trademark) 10G from Kao Corporation, and the like. Examples of the surfactant of the polyoxyethylene lauryl ether salt include EMULGEN (registered trademark) 105 from Kao Corporation, and the like.

Hitherto, an example of surfactants used in the fire-extinguishing liquid agent of the present invention has been described. However, surfactants that can be selected are not limited thereto, and a wide variety of generally available surfactants can be used.

As the surfactants which can be used in the fire-extinguishing liquid agent of the present invention, for example, it is possible to preferably use any of an anionic surfactant which turns into anions when being dissociated in water, a cationic surfactant which turns into cations when being dissociated in water, an amphoteric surfactant (zwitterionic surfactant) which has both the anionic moiety and the cationic moiety in a molecule and turns into cations•amphoteric ions•anions according to the pH of a solution, and a nonionic surfactant which does not have a hydrophilic portion to be ionized. One kind of these surfactants can be used, or two or more kinds of these surfactants can be used in combination.

Examples of other anionic surfactants which can be used in the present invention include a sodium fatty acid, an α-sulfo fatty acid ester salt, linear alkyl benzene sulfonate, an alkyl sulfuric acid ester salt, polyoxyethylene alkyl sulfate, a monoalkyl phosphoric acid ester salt, α-olefin sulfonate, alkane sulfonate, a sodium salt of a β-naphthalenesulfonic acid formalin condensate, a special polycarboxylic acid-type polymer surfactant, and the like.

Examples of the nonionic surfactant which can be used in the present invention include polyoxyethylene alkyl ether, polyoxyethylene fatty acid ester, polyoxyethylene fatty acid sorbitan ester, alkyl polyglucoside, sucrose fatty acid ester, fatty acid diethanolamide, alkyl monoglyceryl ether, and the like.

The cationic surfactant, which requires attention when being combined with a nonionic surfactant but can be used in the present invention, includes an alkyl trimethyl ammonium salt, a dialkyl dimethyl ammonium salt, alkyl benzyl dimethyl ammonium salt, and the like. Furthermore, as the amphoteric surfactant (zwitterionic surfactant), alkyl dimethylamine oxide, alkyl carboxybetaine, an alkylamino fatty acid salt, and the like can also be used.

In a case where the fire-extinguishing liquid agent L according to the present embodiment prepared as above is thrown into a fire source (burning material), ammonium chloride ($NH_4Cl$) and potassium carbonate ($K_2CO_3$) react with each other and release ammonia gas ($NH_3$) and carbon dioxide ($CO_2$), and as a result, potassium chloride (KCl) and water ($H_2O$) are generated.

At this time, the ammonium chloride and the potassium carbonate are in an aqueous solution in which these compounds are thoroughly dissolved. Accordingly, the compounds are heated without burning by flame and react rapidly. Furthermore, at this time, water as the aqueous solution becomes water vapor. The ammonia gas, the carbon dioxide, and the water vapor inhibit burning by rapidly removing the air (oxygen) around the fire source (burning material), thereby extinguishing the fire.

Due to the dispersion effect of the anionic surfactant, the fire-extinguishing agent of the first fire-extinguishing liquid agent floats in the hot water (magnetic water) and then stabilized in a state of being dissolved. Therefore, in a case where the fire-extinguishing liquid agent is thrown into and sprayed onto the fire source (burning material) of an oil fire, the heat of flame is efficiently absorbed into the fire-extinguishing agent, and the reaction generating ammonia gas and carbon dioxide vigorously occurs (the amount of the generated gas increases). Furthermore, in a case where the nonionic surfactant is used, excessive foaming (effervescing action) caused by a surfactant is inhibited, and a high dissolution efficiency resulting from stirring is maintained, and larger amounts of the fire-extinguishing agent can be applied to the heat of the fire source (burning material).

The fire source (burning material) of an oil fire causes water vapor, which is generated by the heat of burning, to be trapped in foams formed by the surfactant and the fire-extinguishing liquid agent.

These foams cover the fire source (burning material) of an oil fire together with a chloride, which becomes a gas after the reaction among the components of the fire-extinguishing agent and remains without being diffused, as if wrapping the fire source, thereby extinguishing the fire by cutting off the contact with the air. These foams can also cover the entirety of a burning material having fluidity or the entirety of a burning material having irregularities as if wrapping the burning material. Furthermore, even after the fire is extinguished, the foams keep covering the inflammable material (material that burned) as if wrapping the material. Therefore, the inflammable material (material that burned) remains cooled and shut off from the air. Consequently, fire recurrence can be inhibited.

In the present embodiment, due to the magnetic treatment, the water molecules undergo a segmentation treatment, and accordingly, the contact area of the water with the agent or the surfactant increases. In addition, because the water is stirred at a high temperature, the number of times of contact between the water molecules and the agent or the surfactant increases, and the dissolution reaction is accelerated. Due to the synergistic effect of these, larger amounts of the agent or the surfactant can be dissolved. Furthermore, even after the water is cooled, the dissolution state tends to be maintained for a long period of time, and a high fire-extinguishing ability can be demonstrated.

Sixth Embodiment

In the present embodiment, a modification example of the fifth embodiment will be described. Similarly to the fifth embodiment, the fire-extinguishing liquid agent according to the first embodiment is used as a first fire-extinguishing liquid agent (A liquid), and a surfactant solution (B liquid) is added to the first fire-extinguishing liquid agent (A liquid), thereby obtaining the fire-extinguishing liquid agent L which can be used for extinguishing oil fires. However, in the present embodiment, instead of the surfactant formed of sodium lauryl sulfate as an anionic surfactant used in the surfactant solution (B liquid) of the fifth embodiment, a special polycarboxylic acid-type polymer surfactant is used.

That is, by using a surfactant of sodium polyoxyethylene alkyl ether sulfate (for example, LATEMUL (registered trademark) from Kao Corporation) as an anionic surfactant of the surfactant solution (B liquid) of the fifth embodiment, a surfactant of a polyoxyethylene lauryl ether salt (for example, EMULGEN (registered trademark) 105 from Kao Corporation) as a nonionic surfactant of the surfactant solution (B liquid) of the fifth embodiment, a special polycarboxylic acid-type polymer surfactant (anionic surfactant), and hot water (magnetic water), the surfactant solution (B liquid) is prepared.

Usable commercial products of the special polycarboxylic acid-type polymer surfactant include DEMOL EP (registered trademark), POISE 520 (registered trademark), and POISE 530 (registered trademark) from Kao Corporation, and the like. It is particularly preferable to select POISE 520 or POISE 530.

In this case, by regarding the amount of hot water (magnetic water), which is treated by passing through a magnetic field having a magnetic flux density of 3,000 to 10,000 G by using the same magnetic treatment portion M as that of the fire-extinguishing liquid agent preparation apparatus 1 of the first embodiment and subjected to temperature control such that the temperature thereof becomes 50° C. to 60° C., as being 100 parts by weight, 4.75 to 5.25 parts of the surfactant of sodium polyoxyethylene alkyl ether sulfate, 9.5 to 10.5 parts of the surfactant of a polyoxyethylene lauryl ether salt, and 7.6 to 8.40 parts of the special polycarboxylic acid-type polymer surfactant are mixed together, and put into the temperature-controlled hot water (magnetic water) having undergone the magnetic treatment. By using the same tank as that of the dissolution treatment portion T and two propeller-like stirring bars (blades) D1 and D2 that are obliquely installed, the mixture is dissolved by being stirred for 30 minutes, thereby obtaining a surfactant solution (B liquid). B liquid and A liquid (first fire-extinguishing liquid agent) described above are mixed together and stirred, thereby obtaining the fire-extinguishing liquid agent L.

Specifically, for example, 50 g of hot water (magnetic water) is mixed with 2.5 g of the surfactant of sodium polyoxyethylene alkyl ether sulfate, 5 g of the surfactant of the polyoxyethylene lauryl ether salt, and 4 g of the special polycarboxylic acid-type polymer surfactant.

In a case where some of the anionic surfactants of the fifth embodiment are changed as described above, the fire-extinguishing agent of the fire-extinguishing liquid agent is more easily dissolved and stabilized in the temperature-controlled solvent (hot water-magnetic water) having undergone a magnetic treatment. Accordingly, the occurrence of a sediment can be inhibited, and the fire-extinguishing effect can be demonstrated.

Furthermore, instead of the surfactants of the sodium lauryl sulfate and the sodium polyoxyethylene alkyl ether sulfate as anionic surfactants used in the surfactant solution (B liquid) of the fifth embodiment, a surfactant of a sodium salt of a β-naphthalenesulfonic acid formalin condensate and a special polycarboxylic acid-type polymer surfactant may be used, and the surfactant of the polyoxyethylene lauryl ether salt which is a nonionic surfactant may not be used.

That is, by using a special polycarboxylic acid-type polymer surfactant (anionic surfactant), a surfactant (anionic surfactant) of a sodium salt of β-naphthalenesulfonic acid formalin condensate, and hot water (magnetic water), the surfactant solution (B liquid) is prepared.

Examples of usable commercial products of the special polycarboxylic acid-type polymer surfactant include DEMOL EP (registered trademark), POISE 520 (registered trademark), and POISE 530 (registered trademark) from Kao Corporation, and the like. It is particularly preferable to select POISE 520 or POISE 530. As the surfactant of a sodium salt of a β-naphthalenesulfonic acid formalin condensate that can be used, DEMOL NL (registered trademark) from Kao Corporation and the like are suitable.

In a case where the anionic surfactants are changed into a surfactant of a sodium salt of a β-naphthalenesulfonic acid formalin condensate and a special polycarboxylic acid-type polymer surfactant as described above, and the surfactant of a polyoxyethylene lauryl ether salt that is a nonionic surfactant is not used, the proportion of the nonionic surfactant mixed in is reduced. Accordingly, the proportion of the fire-extinguishing agent (A liquid) mixed in can be increased. In a case where the proportion of the fire-extinguishing agent (A liquid) is increased, the fire-extinguishing ability is enhanced.

In the present embodiment, due to the magnetic treatment, the water molecules undergo a segmentation treatment, and accordingly, the contact area of the water with the agent or the surfactant increases. In addition, because the water is stirred at a high temperature, the number of times of contact between the water molecules and the agent or the surfactant increases, and the dissolution reaction is accelerated. Due to the synergistic effect of these, larger amounts of the agent or the surfactant can be dissolved. Furthermore, even after the water is cooled, the dissolution state tends to be maintained for a long period of time, and a high fire-extinguishing ability can be demonstrated.

In the present embodiment, the composition and the preparation method of the first fire-extinguishing liquid agent (A liquid) will not be described because they are the same as the composition and the preparation method of the first fire-extinguishing liquid agent (A liquid) described above.

Furthermore, the preparation method of the surfactant solution (B liquid) will not be described herein because it is the same as the preparation method of the surfactant solution (B liquid) of the fifth embodiment.

In addition, the action, which is performed in a case where the fire-extinguishing liquid agent L prepared as above that can be used for oil fires is thrown into a fire source (burning material), will not be described herein because it is the same as the action of the first fire-extinguishing liquid agent (A liquid) and the action of the fire-extinguishing liquid agent (B liquid) according to the fifth embodiment.

Seventh Embodiment

In the present embodiment, the fire-extinguishing liquid agent according to the second embodiment is used as a second fire-extinguishing liquid agent (A liquid), and a surfactant solution (B liquid) is added to the second fire-extinguishing liquid agent (A liquid), thereby obtaining the fire-extinguishing liquid agent L that can be used for extinguishing oil fires.

That is, similarly to the second embodiment, a fire-extinguishing agent including ammonium chloride, potassium carbonate, ammonium phosphate dibasic, and sodium bicarbonate is put into a temperature-controlled hot water (magnetic water) having undergone a magnetic treatment, and dissolved by being stirred for 1 hour by two propeller-like stirring bars (blades) D1 and D2 obliquely installed in the tank of the dissolution treatment portion T, thereby obtaining the second fire-extinguishing liquid agent (A liquid). Furthermore, a surfactant is put into hot water (magnetic water) which is subjected to temperature control in advance such that the temperature thereof becomes 50° C. to 60° C. and has undergone a magnetic treatment at a magnetic flux density of 3,000 to 10,000 G in the magnetic treatment portion M. Then, by using the same tank as that of the dissolution treatment portion T and two propeller-like stirring bars (blades) D1 and D2 that are obliquely installed, the surfactant is dissolved by being stirred for 30 minutes, thereby obtaining the surfactant solution (B liquid). The second fire-extinguishing liquid agent (A liquid) and the surfactant solution (B liquid) are mixed together and stirred, thereby obtaining the fire-extinguishing liquid agent L of the present embodiment.

The preparation of the second fire-extinguishing liquid agent (A liquid) will not be described herein because it is the same as the preparation in the second embodiment.

The preparation of the surfactant solution (B liquid) will not be described herein because it is the same as the preparation of the surfactant solution (B liquid) of the fifth embodiment.

In a case where the fire-extinguishing liquid agent prepared as above that can be used for oil fires is thrown into a fire source (burning material), ammonium chloride ($NH_4Cl$) and potassium carbonate ($K_2CO_3$) react with each other and release ammonia gas ($NH_3$) and carbon dioxide ($CO_2$), and as a result, potassium chloride (KCl) and water ($H_2O$) are generated.

The fire-extinguishing action resulting from the aqueous solution of the fire-extinguishing agent of A liquid will not be described herein because it is the same as the fire-extinguishing action in the second embodiment.

Furthermore, the fire-extinguishing action resulting from the surfactant solution (B liquid) will not be described herein because it is the same as the fire-extinguishing action in the fifth embodiment.

In the present embodiment, similarly to the surfactant solution (B liquid) of the fifth embodiment, surfactants can be selected from a wide variety of surfactants. For example, one or more surfactants may be selected from sodium polyoxyethylene alkyl ether sulfate which is an anionic surfactant, sodium lauryl sulfate which is an anionic surfactant, and a polyoxyethylene lauryl ether salt which is a nonionic surfactant. Furthermore, instead of the anionic surfactants (the surfactant of sodium polyoxyethylene alkyl ether sulfate and the surfactant of sodium lauryl sulfate), a sodium salt of a β-naphthalenesulfonic acid formalin condensate or a special polycarboxylic acid-type polymer surfactant may be used. Alternatively, a sodium salt of a β-naphthalenesulfonic acid formalin condensate and a special polycarboxylic acid-type polymer surfactant may be used, and a polyoxyethylene lauryl ether salt which is a nonionic surfactant may not be used. The operation and effect in this case are also the same as those in the embodiments described above.

In the present embodiment, due to the magnetic treatment, the water molecules undergo a segmentation treatment, and accordingly, the contact area of the water molecules with the agent or the surfactant increases. In addition, because the water is stirred at a high temperature, the number of times of contact between the water molecules and the agent or the surfactant increases, and the dissolution reaction is accelerated. Due to the synergistic effect of these, larger amounts of the agent or the surfactant can be dissolved. Furthermore, even after the water is cooled, the dissolution state tends to be maintained for a long period of time, and a high fire-extinguishing ability can be demonstrated.

Eighth Embodiment

In the present embodiment, the fire-extinguishing liquid agent according to the third embodiment is used as a third fire-extinguishing liquid agent (A liquid), and a surfactant solution (B liquid) is added to the third fire-extinguishing liquid agent (A liquid), thereby obtaining the fire-extinguishing liquid agent L that can be used for extinguishing oil fires.

That is, similarly to the third embodiment, a fire-extinguishing agent including ammonium chloride and sodium bicarbonate is put into temperature-controlled hot water (magnetic water) having undergone a magnetic treatment, and dissolved by being stirred for 1 hour by two propeller-like stirring bars (blades) D1 and D2 obliquely installed in the tank of the dissolution treatment portion T, thereby obtaining the third fire-extinguishing liquid agent (A liquid). Furthermore, a surfactant is put into hot water (magnetic water), which is subjected to temperature control in advance such that the temperature thereof becomes 50° C. to 60° C. and has undergone a magnetic treatment at a magnetic flux density of 3,000 to 10,000 G in the magnetic treatment portion M. By using the same tank as that of the dissolution treatment portion T and two propeller-like stirring bars (blades) D1 and D2 that are obliquely installed, the surfactant is dissolved by being stirred for 30 minutes, thereby obtaining the third surfactant solution (B liquid). The third fire-extinguishing liquid agent (A liquid) and the surfactant solution (B liquid) are mixed together and stirred, and the pH of the mixture is adjusted to fall into a range of 7.5 to 10, thereby obtaining the fire-extinguishing liquid agent L which can be used for oil fires. In the present embodiment, the pH is most preferably 8 to 9.

The preparation of the third fire-extinguishing liquid agent (A liquid) will not be described herein because it is the same as the preparation in the third embodiment.

The preparation of the surfactant solution (B liquid) will not be described herein because it is the same as the preparation of the surfactant solution (B liquid) of the fifth embodiment.

In the present embodiment, the pH of the fire-extinguishing liquid agent L is adjusted to be weakly alkaline. Accordingly, the properties of the fire-extinguishing liquid agent L are stabilized, and the solubility of the fire-extinguishing agent is increased.

That is, in a case where the alkalinity of the fire-extinguishing liquid agent L is high, the fire-extinguishing agent is not easily dissolved, and a sediment is generated at the bottom of the container during the long-term storage. Furthermore, foaming (effervescing action) caused by a surfactant tends to excessively occur.

It has been confirmed that the use of a nonionic surfactant brings about an inhibitory effect on the excessive foaming (effervescing action). The inhibitory effect is also brought about in a case where the pH is adjusted to be weakly alkaline. In a case where both the inhibitory effects are used in combination, it is possible to efficiently control (inhibit) the excessive foaming (effervescing action).

The action, which is performed in a case where the fire-extinguishing liquid agent L prepared as above that can be used for oil fires is thrown into a fire source (burning material), will not be described herein because it is the same as the action of the fire-extinguishing liquid agent (A liquid) according to the third embodiment and the action of the fire-extinguishing liquid agent (B liquid) according to the fifth embodiment.

In the present embodiment, similarly to the surfactant solution (B liquid) of the fifth embodiment, surfactants can be selected from a wide variety of surfactants. For example, one or more surfactants may be selected from sodium polyoxyethylene alkyl ether sulfate which is an anionic surfactant, sodium lauryl sulfate which is an anionic surfactant, and a polyoxyethylene lauryl ether salt which is a nonionic surfactant. Furthermore, instead of the anionic surfactants (the surfactant of sodium polyoxyethylene alkyl ether sulfate and the surfactant of sodium lauryl sulfate), a sodium salt of a β-naphthalenesulfonic acid formalin condensate or a special polycarboxylic acid-type polymer surfactant may be used. Alternatively, a sodium salt of a β-naphthalenesulfonic acid formalin condensate and a special polycarboxylic acid-type polymer surfactant may be used, and a polyoxyethylene lauryl ether salt which is a nonionic surfactant may not be used. The operation and effect in this case are also the same as those in the embodiments described above.

In the present embodiment, due to the magnetic treatment, the water molecules undergo a segmentation treatment, and accordingly, the contact area of the water with the agent or the surfactant increases. In addition, because the water is stirred at a high temperature, the number of times of contact between the water molecules and the agent or the surfactant increases, and the dissolution reaction is accelerated. Due to the synergistic effect of these, larger amounts of the agent or the surfactant can be dissolved. Furthermore, even after the water is cooled, the dissolution state tends to be maintained for a long period of time, and a high fire-extinguishing ability can be demonstrated.

Ninth Embodiment

In the present embodiment, the fire-extinguishing liquid agent according to the fourth embodiment is used as a fourth fire-extinguishing liquid agent (A liquid), and a surfactant solution (B liquid) is added to the fourth fire-extinguishing liquid agent (A liquid), thereby obtaining the fire-extinguishing liquid agent L that can be used for extinguishing oil fires.

That is, similarly to the fourth embodiment, a fire-extinguishing agent including ammonium chloride, ammonium phosphate dibasic, and sodium bicarbonate is put into temperature-controlled hot water (magnetic water) having undergone a magnetic treatment, and is dissolved by being stirred for 1 hour by two propeller-like stirring bars (blades) D1 and D2 that are obliquely installed in the tank of the dissolution treatment portion T, thereby obtaining the fourth fire-extinguishing liquid agent (A liquid). Furthermore, a surfactant is put into hot water (magnetic water), which is subjected to temperature control in advance such that the temperature thereof becomes 50° C. to 60° C. and has undergone a magnetic treatment at a magnetic flux density of 3,000 to 10,000 G in the magnetic treatment portion M. By using the same tank as that of the dissolution treatment portion T and two propeller-like stirring bars (blades) D1 and D2 that are obliquely installed, the surfactant is dissolved by being stirred for 30 minutes, thereby obtaining the surfactant solution (B liquid). The third fire-extinguishing liquid agent (A liquid) and the surfactant solution (B liquid) are mixed together and stirred, and the pH thereof is adjusted to fall into a range of 7.5 to 10, thereby obtaining the fire-extinguishing liquid agent L which can be used for oil fires. In the present embodiment, the pH is most preferably 8 to 9.

The preparation of the fourth fire-extinguishing liquid agent (A liquid) will not be described herein because it is the same as the preparation in the fourth embodiment.

The preparation of the surfactant solution (B liquid) will not be described herein because it is the same as the preparation of the surfactant solution (B liquid) of the fifth embodiment.

In the present embodiment, similarly to the seventh embodiment, the pH of the fire-extinguishing liquid agent L is adjusted to be weakly alkaline. Accordingly, the properties of the fire-extinguishing liquid agent L are stabilized, and the solubility of the fire-extinguishing agent is increased. The operation and effect thereof will not be described herein because they are the same as the operation and effect of the seventh embodiment.

The action, which is performed in a case where the fire-extinguishing liquid agent prepared as above that can be used for oil fires is thrown into a fire source (burning material), will not be described herein because it is the same as the action of the fire-extinguishing liquid agent (A liquid) according to the fourth embodiment and the action of the fire-extinguishing liquid agent (B liquid) according to the fifth embodiment.

In the present embodiment, similarly to the surfactant solution (B liquid) of the fifth embodiment, surfactants can be selected from a wide variety of surfactants. For example, one or more surfactants may be selected from sodium polyoxyethylene alkyl ether sulfate which is an anionic surfactant, sodium lauryl sulfate which is an anionic surfactant, and a polyoxyethylene lauryl ether salt which is a nonionic surfactant. Furthermore, instead of the anionic surfactants (the surfactant of sodium polyoxyethylene alkyl ether sulfate and the surfactant of sodium lauryl sulfate), a sodium salt of a β-naphthalenesulfonic acid formalin condensate or a special polycarboxylic acid-type polymer surfactant may be used. Alternatively, a sodium salt of a β-naphthalenesulfonic acid formalin condensate and a special polycarboxylic acid-type polymer surfactant may be used, and a polyoxyethylene lauryl ether salt which is a nonionic surfactant may not be used. The operation and effect in this case are also the same as those in the embodiments described above.

In the present embodiment, due to the magnetic treatment, the water molecules undergo a segmentation treatment, and accordingly, the contact area of the water with the agent or the surfactant increases. In addition, because the water is stirred at a high temperature, the number of times of contact between the water molecules and the agent or the surfactant increases, and the dissolution reaction is accelerated. Due to the synergistic effect of these, larger amounts of the agent or the surfactant can be dissolved. Furthermore, even after the water is cooled, the dissolution state tends to be maintained for a long period of time, and a high fire-extinguishing ability can be demonstrated.

Tenth Embodiment

In a case where the fire-extinguishing liquid agents (including the fire-extinguishing liquid agents which can be used for oil fires) according to the first to eighth embodiments directly flow into a fire source (burning material), ammonia gas and carbon dioxide are generated, and as a result, the fire can be extinguished. However, in a case where an impact breakable container (bottle) B into which each of the fire-extinguishing liquid agents is sealed is thrown into a fire source (burning material), it is possible to extinguish the fire without touching the fire source (burning material) by hand.

The impact breakable container (bottle) B to be loaded with the fire-extinguishing liquid agent is, for example, formed to have a cylindrical shape having a size that enables the container to be held by one hand as shown in FIGS. 3 to 7.

Figure 3:
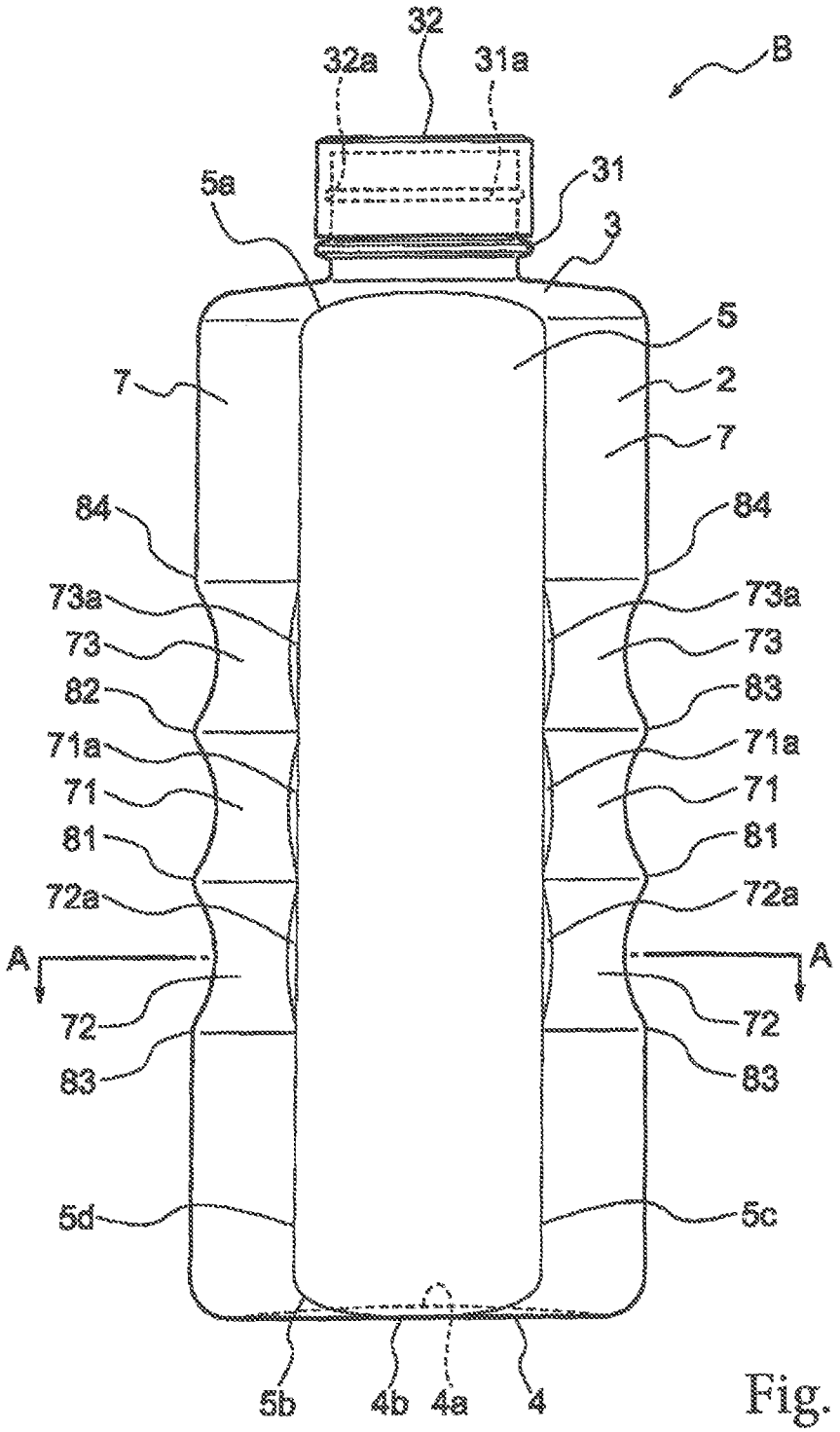
FIG. 3 is a front view of an impact breakable container.
Figure 4:
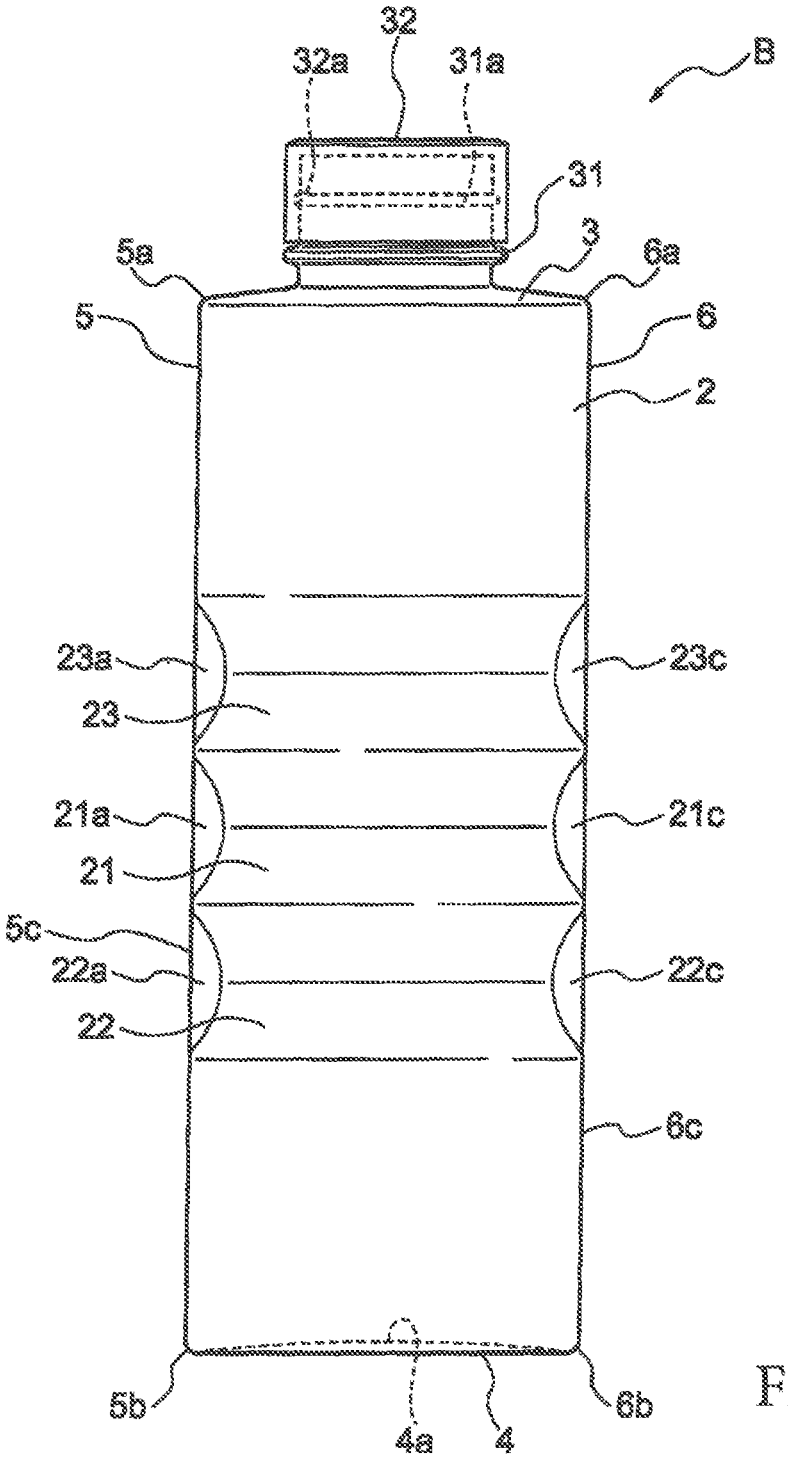
FIG. 4 is a view showing a right lateral surface of the impact breakable container.
Figure 5:
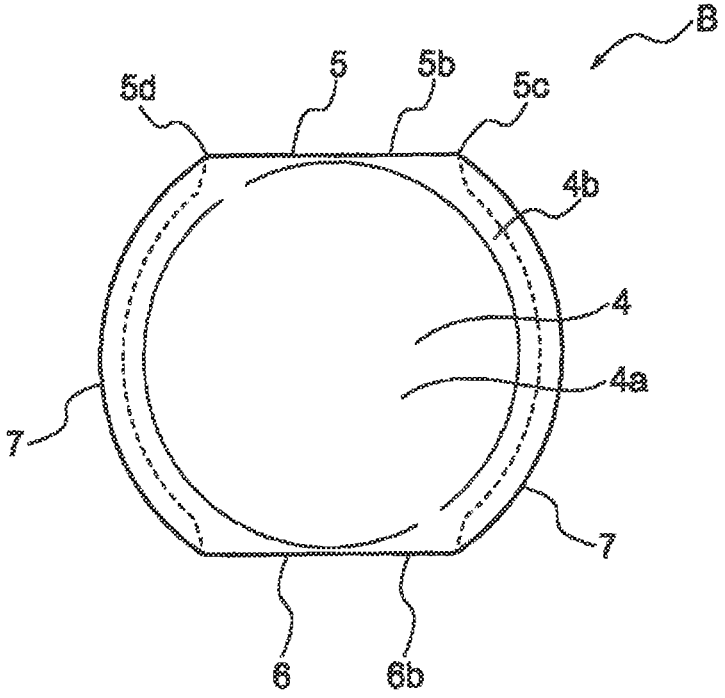
FIG. 5 is a bottom view of the impact breakable container.
Figure 6:
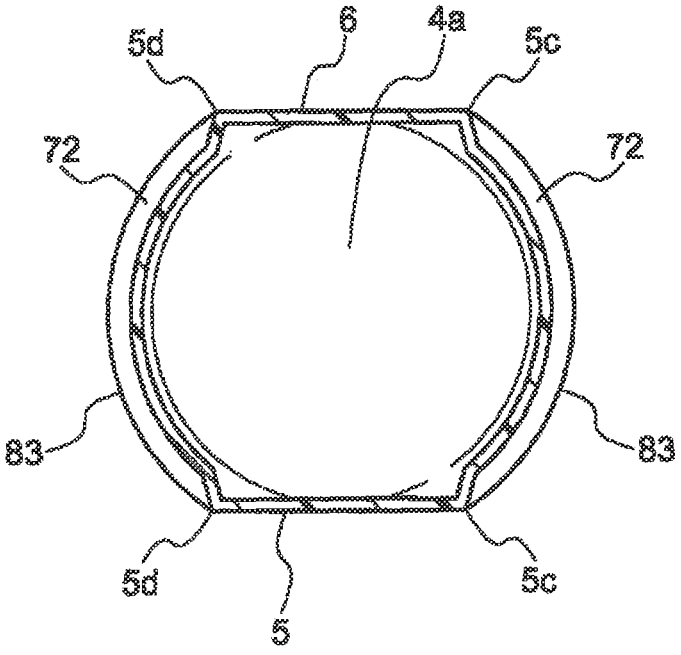
FIG. 6 is a cross-sectional view taken along the line A-A in FIG. 3.
Figure 7:
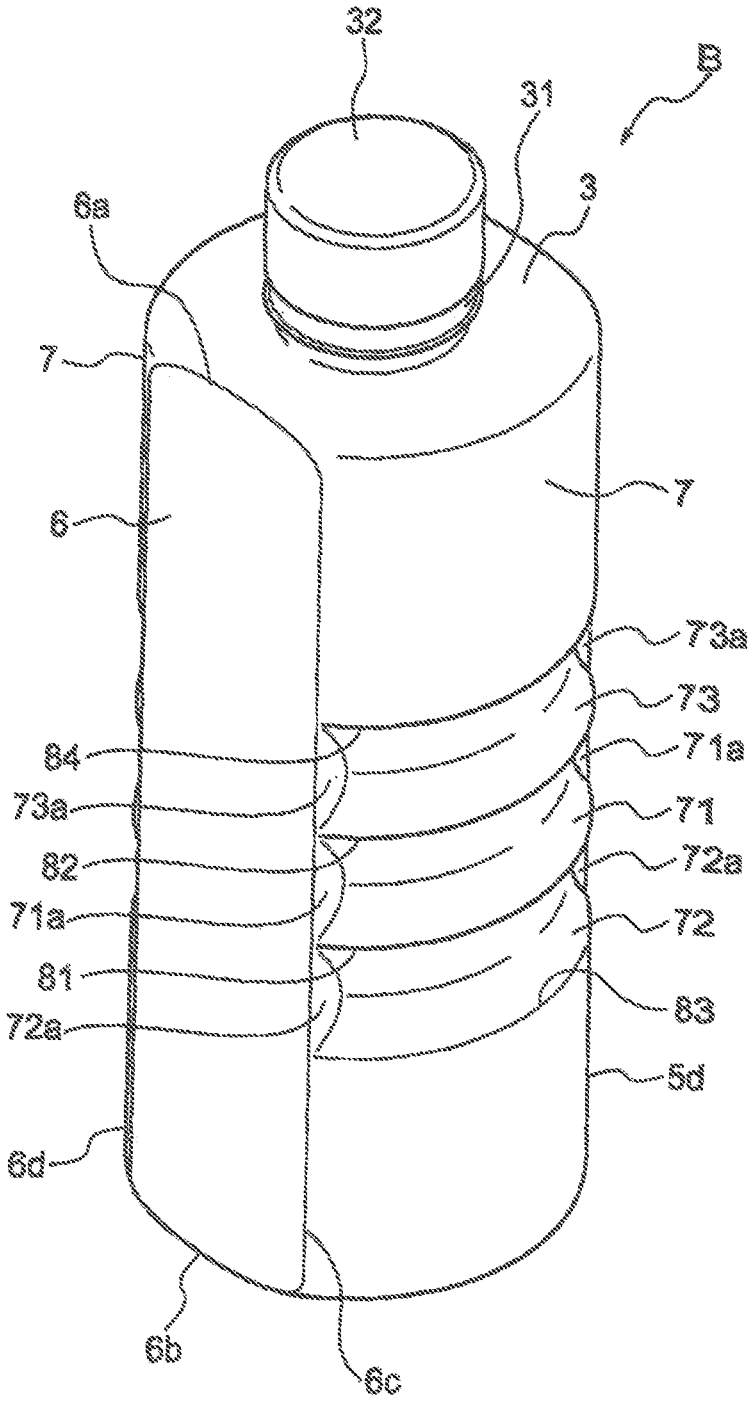
FIG. 7 is a perspective view of the impact breakable container.

FIG. 3 is a front view of the impact breakable container (bottle) B. FIG. 4 is a view showing a right lateral surface of the container B. FIG. 5 is a bottom view of the container B. FIG. 6 is a cross-sectional view taken along the line A-A in FIG. 3. FIG. 7 is a perspective view of the container B.

The impact breakable container (bottle) B is constituted with a cylindrical portion 2 formed to have a predetermined height, a top surface portion 3 formed to block the upper end of the cylindrical portion 2, and a bottom surface portion 4 formed to block the lower end of the cylindrical portion 2.

The cylindrical portion 2 is in the form of a cylinder including a front-side flat surface portion 5 formed as a flat surface having a predetermined width that extends to the bottom surface portion 4 from the top surface portion 3, a rear-side flat surface portion 6 formed as a flat surface which extends to the bottom surface portion 4 from the top surface portion 3, is parallel to the front-side flat surface portion 5, and has the same width as that of the front-side flat surface portion 5, and two curved surface portions 7 formed by connecting the front-side flat surface portion 5 and the rear-side flat surface portion 6 through convex surfaces.

The width of the front-side flat surface portion 5 is set to be slightly larger than half of the maximum diameter (diameter at which two curved surface portions 7 are formed) of the cylindrical portion 2. Furthermore, an upper edge 5*a* (boundary with the top surface portion 3), a lower edge 5*b* (boundary with the bottom surface portion 4), a right edge 5*c* (boundary with the curved surface portion 7), and a left edge 5*d* (boundary with the curved surface portion 7) of the front-side flat surface portion 5 are angulated without being chamfered.

The rear-side flat surface portion 6 on the rear surface side (right side in FIG. 4) has the same shape as the front-side flat surface portion 5. Furthermore, an upper edge 6*a* (boundary with the top surface portion 3), a lower edge 6*b* (boundary with the bottom surface portion 4), a right edge 6*c* (boundary with the curved surface portion 7), and a left edge 6*d* (boundary with the curved surface portion 7) of the rear-side flat surface portion 6 are angulated without being chamfered.

Approximately at the central portion in the vertical direction of the curved surface portions 7, a concave peripheral surface 71 having a predetermined height is formed which connects the front-side flat surface portion 5 and the rear-side flat surface portion 6 in the horizontal direction.

The height at which the concave peripheral surface 71 is to be formed is set to be a size that is approximately twice the thickness of an adult's finger. For example, the height may be set to be about 27 mm.

The concave peripheral surface 71 is connected to the boundary portion with the curved surface portions 7 on the left and right end sides of the concave peripheral surface 71 through a stepped surface 71*a*.

Under the concave peripheral surface 71, a concave peripheral surface 72 is formed which is adjacent to the concave peripheral surface 71 and has the same shape as the concave peripheral surface 71. The concave peripheral surface 72 is connected to the boundary portion with the curved surface portions 7 on the left and right end sides of the concave peripheral surface 72 through a stepped surface 72*a*.

On the concave peripheral surface 71, a concave peripheral surface 73 is formed which is adjacent to the concave peripheral surface 71 and has the same shape as the concave peripheral surface 71. The concave peripheral surface 73 is connected to the boundary portion with the curved surface portions 7 on the left and right end sides of the concave peripheral surface 73 through a stepped surface 73*a*.

Each of a portion 81 in which the concave peripheral surface 71 and the concave peripheral surface 72 are adjacent to each other, a portion 82 in which the concave peripheral surface 71 and concave peripheral surface 73 are adjacent to each other, a portion 83 connected to the curved surface portion 7 under the concave peripheral surface 71, and a portion 84 connected to the curved surface portion 7 on the concave peripheral surface 73 is angulated.

The concave peripheral surface 71 is positioned such that it becomes the barycenter in a case where the impact breakable container (bottle) B is loaded with the fire-extinguishing liquid agent. In a case where a user holds the impact breakable container (bottle) B with his/her middle finger at the concave peripheral surface 71, the index finger and the ring finger of the user are at the concave peripheral surface 72 and the concave peripheral surface 73. Furthermore, the user's thumb is at any of the concave peripheral surface 72 and the concave peripheral surface 73 formed on the other side, and the user's palm is placed on either the front-side flat surface portion 5 or the rear-side flat surface portion 6. Accordingly, the impact breakable container (bottle) B is tightly held in the hand without rolling.

Furthermore, because fingertips are hooked around the stepped surfaces 71*a*, 72*a*, and 73*a*, even though the user holds the container with a wet hand, the impact breakable container (bottle) B does not slip.

The impact breakable container (bottle) B is tightly held in the hand as described above. Therefore, at the time of throwing the container, it is easy to aim the container at a fire source (burning material) and throw the container to the aimed source.

At the central portion of the top surface portion 3, there is an inlet port 31 which is formed integrally with the top surface portion 3, protrudes upwards, and has the shape of a circular ring communicating with the inside and outside of the bottle. On the outer peripheral side of the inlet port 31, a fitting convex portion 31*a* extending along the circumferential direction is formed.

A cap 32 made of plastic is fitted to the exterior of the inlet port 31. The inner diameter of the cap 32 is set to be slightly larger than the outer diameter of the inlet port 31. A fitting concave portion 32*a* is formed at a position corresponding to the fitting convex portion 31*a* of the inlet port 31.

The inlet port 31 functions as an inlet for the interior of the bottle B to be loaded with the fire-extinguishing liquid agent. After the loading of the fire-extinguishing liquid agent is finished, the cap 32 is pressed by a capper, and the fitting convex portion 31*a* of the inlet port 31 is fitted to the fitting concave portion 32*a* of the cap 32. As a result, the cap 32 is firmly fixed to the inlet port 31 such that the cap is not easily taken off, and the inlet port 31 is closed.

The bottom surface portion 4 includes a concave portion 4*a* formed of the central portion of the bottom surface portion 4 that is slightly depressed upwards and an edge portion 4*b* formed in a horizontal ring shape around the concave portion 4*a*.

In a case where the impact breakable container (bottle) B is made stand on the flat surface of a table or the like, the edge portion 4*b* formed in a horizontal ring shape contacts the flat surface of the table. Accordingly, the bottle B is stably positioned.

The size of each portion of the impact breakable container (bottle) B may be appropriately set as necessary. For example, the length between the front-side flat surface portion 5 and the rear-side flat surface portion 6 is set to be 70 mm, the length between the curved surface portion 7 and the opposite curved surface portion 7 is set to be 83 mm. The height of the bottle B excluding the inlet port 31 is set to be 182 mm. The thickness of the impact breakable container (bottle) B is set to be about 2 mm.

The internal capacity of the impact breakable container (bottle) B is preferably 500 ml to 1,200 ml.

In a case where the internal capacity is smaller than 500 ml, the number of impact breakable containers (bottles) B required to extinguish a fire source (burning material) increase. Accordingly, the number of times of performing a fire-extinguishing operation (motion of throwing the impact breakable container to the fire source) increases as well, which leads to a problem of increasing the time required for fire extinguishment.

In a case where the internal capacity is larger than 1,200 ml, although the number of impact breakable containers (bottles) B required to extinguish the fire of a fire source (burning material) is reduced, the bottle becomes heavy. Accordingly, a problem occurs in that skillfulness is required for a throwing motion for throwing the bottle exactly to the aimed fire source.

For the impact breakable container (bottle) to be loaded with each of the fire-extinguishing liquid agents (including fire-extinguishing liquid agents which can be used for oil fires) according to the first to ninth embodiments, the internal capacity is most preferably set to be 800 ml.

The impact breakable container (bottle) B is required to be able to store the fire-extinguishing liquid agent, which is loaded on and sealed into the interior thereof, for a long period of time without alteration, and required to be easily broken by the impact of the collision with a fire source or the periphery thereof in a case where the bottle is thrown into the fire source (burning material).

Therefore, the impact breakable container (bottle) B is formed in a predetermined shape by using a material obtained by mixing 100 parts by weight of general-purpose polystyrene (GPPS) with 9 to 30 parts of high impact polystyrene (HIPS) which is a styrene-butadiene copolymer.

In a case where the proportion of the high impact polystyrene is lower than 9 parts, the impact breakable container (bottle) is easily broken by a small impact. In a case where the proportion of the high impact polystyrene is higher than 30 parts, sometimes the bottle is not broken by the impact of the collision with a fire source or the periphery thereof.

In the present embodiment, the proportion of the high impact polystyrene mixed in is most preferably 9 parts.

The high impact polystyrene is a resin material into which butadiene as a rubber component is incorporated so as to improve the impact resistance. In a case where this material is mixed with general-purpose polystyrene at the proportion described above, the formed impact breakable container (bottle) B obtains impact resistance which allows the bottle to be easily broken by the impact of the collision described above but makes the bottle maintain a certain strength at the time of storage such that the bottle is not easily broken. Furthermore, compared to vinyl chloride or the like, the resin material exhibits higher durability against decomposition resulting from long-term exposure to ultraviolet rays or oxygen.

In a case where a coloring material is mixed with the resin material forming the impact breakable container (bottle) B, a non-transparent impact breakable container (bottle) can be formed. Because the bottle is non-transparent, the fire-extinguishing liquid agent in the interior of the bottle is not affected by light rays (solar rays, lighting, and the like) radiated to the bottle from the outside, and the fire-extinguishing liquid agent can be stored for a long period of time.

Considering that polystyrene has a characteristic of being easily broken by impact, as the material of the impact breakable container (bottle), a material obtained by mixing together the aforementioned general-purpose polystyrene and the high impact polystyrene at a predetermined mixing ratio is particularly preferably selected. However, the material of the impact breakable container is not limited thereto. For example, low-density polyethylene, high-density polyethylene, polypropylene, and the like can also be used.

The impact breakable container (bottle) is formed of a material which is relatively easily broken, and has a shape in which a plurality of angulated portions are formed on the edge portions of the front-side flat surface portion 5 and the rear-side flat surface portion 6 and on the concave peripheral surfaces 71, 72, and 73. Accordingly, in a case where the bottle is thrown into a fire source (burning material), the impact of the collision with the fire source or the periphery thereof becomes a stress concentrated on the angulated portions and leads to the breakage of the container (bottle) B. Consequently, even though the impact of the collision is relatively low, the impact breakable container (bottle) B can be broken, and the fire-extinguishing liquid agent loaded on the interior thereof can be sprayed onto the fire source (burning material).

The arrangement of the angulated portions on the impact breakable container (bottle) B is not limited to the above description. According to the exterior appearance of the impact breakable container (bottle) B and the like, the angulated portions may be freely increased or reduced and arranged. Furthermore, as long as it is certain that the impact breakable container (bottle) B is broken by falling impact, the impact breakable container (bottle) B may not have the angulated portions in some cases.

EXAMPLES

Fire Extinguishment Test 1 (Normal Fire)

1. Example and Comparative Example (1) Preparation of Impact Breakable Container (Example) Loaded with Fire-Extinguishing Liquid Agent In hot water (magnetic water), which was subjected to temperature control in advance such that the temperature thereof became 40° C. and had undergone a magnetic treatment, ammonium chloride ($NH_4Cl$) (main agent) and potassium carbonate ($K_2CO_3$) were dissolved such that the content of $K_2CO_3$ became 72.21 parts with respect to 100 parts by weight of $NH_4Cl$, thereby preparing a fire-extinguishing liquid agent. Specifically, 14.32 kg of ammonium chloride was mixed with 10.34 kg of potassium carbonate, and the mixture was dissolved in 82 kg (82 L) of hot water (magnetic water), thereby preparing 100 kg (100 L) of a fire-extinguishing liquid agent (Example 1). Furthermore, a resin material, which was obtained by mixing 100 parts by weight of general-purpose polystyrene with 7 parts of high impact polystyrene, was molded into a bottle shape (shape of the present invention) having a thickness of 2 mm including angulated portions, a front-side flat surface portion, a rear-side flat surface portion, and concave peripheral surfaces, thereby obtaining an impact breakable container. The container was loaded with 800 ml of the fire-extinguishing liquid agent and sealed.

(2) Preparation of Impact Breakable Container (Comparative Example) Loaded with Fire-Extinguishing Liquid Agent In 20° C. tap water, ammonium chloride ($NH_4Cl$) (main agent) and potassium carbonate ($K_2CO_3$) were dissolved such that the content of the $K_2CO_3$ became 50 parts with respect to 100 parts by weight of the $NH_4Cl$, thereby preparing a fire-extinguishing liquid agent (Comparative Example 1). Furthermore, a vinyl chloride resin was molded into a cylindrical bottle shape having a thickness of 2 mm, thereby obtaining an impact breakable container. The impact breakable container was loaded with 800 ml of the fire-extinguishing liquid agent and sealed.

(3) Fire Extinguishment Test

A. Testing Method 1 (Normal Fire)

A class A fire model (second model) stipulated in paragraph 2 of article 3 of the law (1964, Ordinance of Ministry of Home Affairs, No. 27) defining the technical standards of fire extinguishers was prepared for each of fire extinguishment tests, and ignited using the fuel stipulated in the same paragraph. After the flame from the cedar of the same model was checked, the number of impact breakable containers loaded with the fire-extinguishing liquid agent that were thrown by a thrower until the fire was extinguished and the time taken for the fire to be extinguished from when the container started to be thrown were tested.

B. The Test Results are Shown in Table 2.

TABLE 2

Fire extinguishment test 1 (normal fire)

| | Test No. | A thrower | The number | Time taken for the fire to be extinguished | Result |
|---|---|---|---|---|---|
| Comparative example 1 | 1 | Male 64 years old | 5 | 20 seconds | extinction |
| | 2 | Male 54 years old | 4 | 18 seconds | extinction |
| | 3 | Male 61 years old | 3 | 15 seconds | extinction |
| Embodiment | 4 | Male 54 years old | 1 | 11 seconds | extinction |
| | 5 | Male 50 years old | 1 | 8 seconds | extinction |
| | 6 | Female 34 years old | 1 | 10 seconds | extinction |
| | 7 | Male 10 years old | 1 | 8 seconds | extinction |
| | 8 | Female 12 years old | 1 | 7 seconds | extinction |
| | 9 | Male 72 years old | 1 | 8 seconds | extinction |
| | 10 | Female 66 years old | 1 | 10 seconds | extinction |

As is evident from the results of the comparative examples and the examples of the fire extinguishment test 1, in all the tests, the number of containers thrown was smaller and the time required for fire extinguishment was shorter in the examples than in the comparative examples.

Particularly, in test No. 1 (comparative example), some of the bottles did not hit the fire model, and accordingly, the number of bottles thrown and the time required for fire extinguishment were increased. It is considered that because the bottles of the comparative examples were in the form of a cylinder which did not have hooks on the peripheral surface thereof, the fire model might be inaccurately aimed at the time of throwing. Furthermore, it is considered that because bottles were not held at the position of barycenter, the bottles might fly along a seriously wrong track and might not hit the fire model.

In each of the tests of the examples, the thrower hooked his/her fingers around the concave peripheral surfaces and covered the flat surface portions on the front side/rear side with his/her palm, and it took a short time to take aim before throwing.

Fire Extinguishment Test 2 (Oil Fire)

1. Example and Comparative Example (1) Preparation of Impact Breakable Container (Example) Loaded with Fire-Extinguishing Liquid Agent By regarding the amount of hot water (magnetic water), which was treated by passing through a magnetic field having a magnetic flux density of 3,000 to 10,000 G and subjected to temperature control such that the temperature thereof became 60° C., as being 100 parts by weight, 4,808 parts of a surfactant of sodium polyoxyethylene alkyl ether sulfate, 8,173 parts of a surfactant of sodium lauryl sulfate, and 10,096 parts of a surfactant of a polyoxyethylene lauryl ether salt were mixed together and dissolved in the hot water by being stirred for 30 minutes, thereby obtaining a surfactant solution (B liquid). In hot water (magnetic water), which had been subjected to temperature control in advance such that the temperature thereof became 40° C. and had undergone a magnetic treatment, ammonium chloride ($NH_4Cl$) (main agent) and potassium carbonate ($K_2CO_3$) were dissolved such that the content of the $K_2CO_3$ became 72.21 parts with respect to 100 parts by weight of the $NH_4Cl$, thereby obtaining a fire-extinguishing liquid agent (A liquid). A liquid and B liquid were mixed together and stirred, thereby preparing a fire-extinguishing liquid agent L (example). A resin material, which was obtained by mixing 100 parts by weight of general-purpose polystyrene with 7 parts of high impact polystyrene, was molded into a bottle shape having a thickness of 2 mm including angulated portions, thereby obtaining an impact breakable container. The container was loaded with 800 ml of the fire-extinguishing liquid agent L and sealed.

(2) Preparation of Impact Breakable Container (Comparative Example) Loaded with Fire-Extinguishing Liquid Agent In 20° C. tap water ($H_2O$), ammonium chloride ($NH_4Cl$) (main agent) and potassium carbonate ($K_2CO_3$) were dissolved such that the content of the $K_2CO_3$ became 50 parts with respect to 100 parts by weight of the $NH_4Cl$. The resulting solution was mixed with a surfactant of sodium polyoxyethylene alkyl ether sulfate at a proportion of 3 parts, a surfactant of sodium lauryl sulfate at a proportion of 6 parts, and a surfactant of a polyoxyethylene lauryl ether salt at a proportion of 8 part, and the mixture was stirred, thereby preparing a fire-extinguishing liquid agent (comparative example). A vinyl chloride resin was molded into a bottle shape having a thickness of 2 mm, thereby obtaining an impact breakable container. The container was loaded with 800 ml of the fire-extinguishing liquid agent and sealed.

(3) Fire Extinguishment Test

A. Testing Method 2 (Oil Fire)

A class B fire model stipulated in paragraph 2 of article 4 of the law (1964, Ordinance of Ministry of Home Affairs, No. 27) defining the technical standards of fire extinguishers was prepared for each of fire extinguishment tests, and ignited using the fuel stipulated in the same paragraph. After the flame from the cedar of the same model was checked, the number of impact breakable containers loaded with the fire-extinguishing agent that were thrown by a thrower until the fire was extinguished and the time taken for the fire to be extinguished from when the container started to be thrown were tested.

B. The Test Results are Shown in Table 3.

TABLE 3

| Fire extinguishment test 2 (oil fire) | | | | | |
|---|---|---|---|---|---|
| | Test No. | A thrower | The number | Time taken for the fire to be extinguished | Result |
| Comparative example 1 | 1 | Male 64 years old | 2 | 18 seconds | extinction |
| | 2 | Male 54 years old | 3 | 20 seconds | extinction |
| | 3 | Male 61 years old | 2 | 15 seconds | extinction |
| Embodiment | 4 | Male 54 years old | 1 | 10 seconds | extinction |
| | 5 | Male 50 years old | 1 | 9 seconds | extinction |
| | 6 | Female 34 years old | 1 | 10 seconds | extinction |
| | 7 | Male 10 years old | 1 | 6 seconds | extinction |
| | 8 | Female 12 years old | 1 | 7 seconds | extinction |
| | 9 | Male 72 years old | 1 | 9 seconds | extinction |
| | 10 | Female 66 years old | 1 | 10 seconds | extinction |

As is evident from the results of the comparative examples and the examples of the fire extinguishment test 2, in all the tests, the number of containers thrown was smaller and the time required for fire extinguishment were shorter in the examples than in the comparative examples.

Fire Extinguishment Test 3 (Oil Fire)

1. Example and Comparative Example (1) Preparation of Fire-Extinguishing Liquid Agent (Example)

The fire-extinguishing liquid agent L (example) prepared in the fire extinguishment test 2 (oil fire) was used without being loaded onto an impact breakable container.

(2) Preparation of Fire-Extinguishing Liquid Agent (Comparative Example)

The fire-extinguishing liquid agent (comparative example) prepared in the fire extinguishment test 2 (oil fire) was used without being loaded onto an impact breakable container.

(3) Fire Extinguishment Test

A. Testing Method 3 (Oil Fire)

A certain amount of frying oil was prepared in a metal container and ignited. After the flame from the oil was checked, the amount of the fire-extinguishing liquid agent consumed until the fire was extinguished and the time required for the fire to be extinguished from when the fire-extinguishing liquid agent started to be poured were tested.

B. The Test Results are Shown in Table 4.

TABLE 4

| Fire extinguishment test 3 (oil fire) | | | | | |
|---|---|---|---|---|---|
| | Test No. | An amount of liquid | fire-extinguishing liquid agent | Time taken for the fire to be extinguished | Result |
| Comparative example | 1 | 100 ml | 20 ml | 2 seconds | extinction |
| | 2 | 300 ml | 60 ml | 3 seconds | extinction |
| Embodiment | 3 | 300 ml | 50 ml | Less than 1 second | extinction |
| | 4 | 600 ml | 80 ml | Less than 1 second | extinction |
| | 5 | 1000 ml | 80 ml | Less than 1 second | extinction |

As is evident from the results of the comparative examples and the examples of the fire extinguishment test 3, in all the tests, the amount of the fire-extinguishing liquid agent consumed for extinguishing the fire was smaller and the time required for fire extinguishment were shorter in the examples than in the comparative examples.

INDUSTRIAL APPLICABILITY

The fire-extinguishing liquid agent according to the present invention and the fire-extinguishing equipment according to the present invention loaded with the fire-extinguishing liquid agent are most effective for extinguishing early stage fires such as an accidental fire (normal fire) in a living room of private homes or a frying oil fire (oil fire) in a kitchen. Furthermore, the fire-extinguishing liquid agent and the fire-extinguishing equipment feature the cooling action performed by shutting off a fire source (burning material) from the air. Therefore, the fire-extinguishing liquid agent and the fire-extinguishing equipment can be used for local fires in outdoor spaces such as street vendors, and can also demonstrate sufficient effects in wide spaces such as factories or warehouses as long as the fire is localized. In addition, at the time of clearing up after fire extinguishment, the fire-extinguishing liquid agent and the fire-extinguishing equipment do not make the fire-extinguishing agent scattered unlike a powder fire extinguisher or the like, and do not use a toxic substance. Accordingly, the fire-extinguishing liquid agent and the fire-extinguishing equipment are suitable for extinguishing early stage fires in customer attracting facilities.

REFERENCE SIGNS LIST

1 Fire-extinguishing liquid agent preparation apparatus
2 Cylindrical portion
3 Top surface portion
4 Bottom surface portion
5 front-side flat surface portion
6 Rear-side flat surface portion
7 Curved surface portion
71, 72, 73 Concave peripheral surface
B Impact breakable container (bottle)

The invention claimed is:

1. Fire-extinguishing equipment, comprising:

a fire-extinguishing agent containing ammonium chloride and potassium carbonate, wherein a content of the potassium carbonate is 68 to 76 parts with respect to 100 parts by weight of the ammonium chloride, and the fire-extinguishing liquid agent is obtained by dissolving the fire-extinguishing agent in hot water which is treated by passing through a magnetic field having a magnetic flux density of 3,000 to 10,000 G and has a temperature of 30° C. to 50° C.; and an impact breakable container formed by molding a polystyrene resin material obtained by mixing general-purpose polystyrene with a styrene-butadiene copolymer, wherein the fire-extinguishing liquid agent is sealed into the impact breakable container, and the outer peripheral surface of the impact breakable container has angulated portions on which stress caused by impact is concentrated.

2. Fire-extinguishing equipment, comprising:

a fire-extinguishing agent containing ammonium chloride, potassium carbonate, ammonium phosphate dibasic, and sodium bicarbonate, wherein a content of the potassium carbonate is 61 to 68 parts, a content of the ammonium phosphate dibasic is 19 to 22 parts, and a content of the sodium bicarbonate is 11 to 13 parts, with respect to 100 parts by weight of the ammonium chloride, and the fire-extinguishing liquid agent is obtained by dissolving the fire-extinguishing agent in hot water which is treated by passing through a magnetic field having a magnetic flux density of 3,000 to 10,000 G and has a temperature of 30° C. to 50° C.; and an impact breakable container formed by molding a polystyrene resin material obtained by mixing general-purpose polystyrene with a styrene-butadiene copolymer, wherein the fire-extinguishing liquid agent is sealed into the impact breakable container, and the outer peripheral surface of the impact breakable container has angulated portions on which stress caused by impact is concentrated.

3. Fire-extinguishing equipment, comprising:

a fire-extinguishing agent containing ammonium chloride and sodium bicarbonate, wherein a content of the sodium bicarbonate is 68 to 76 parts with respect to 100 parts by weight of the ammonium chloride, the fire-extinguishing liquid agent is obtained by dissolving the fire-extinguishing agent in hot water which is treated by passing through a magnetic field having a magnetic flux density of 3,000 to 10,000 G and has a temperature of 30° C. to 50° C., and a pH of the fire-extinguishing liquid agent is within a range of 7.5 to 10; and an impact breakable container formed by molding a polystyrene resin material obtained by mixing general-purpose polystyrene with a styrene-butadiene copolymer, wherein the fire-extinguishing liquid agent is sealed into the impact breakable container, and the outer peripheral surface of the impact breakable container has angulated portions on which stress caused by impact is concentrated.

4. Fire-extinguishing equipment, comprising:

a fire-extinguishing agent containing ammonium chloride, ammonium phosphate dibasic, and sodium bicarbonate, wherein a content of the ammonium phosphate dibasic is 19 to 22 parts and a content of the sodium bicarbonate is 71 to 81 parts, with respect to 100 parts by weight of the ammonium chloride, the fire-extinguishing liquid agent is obtained by dissolving the fire-extinguishing agent in hot water which is treated by passing through a magnetic field having a magnetic flux density of 3,000 to 10,000 G and has a temperature of 30° C. to 50° C., and a pH of the fire-extinguishing liquid agent is within a range of 7.5 to 10; and an impact breakable container formed by molding a polystyrene resin material obtained by mixing general-purpose polystyrene with a styrene-butadiene copolymer, wherein the fire-extinguishing liquid agent is sealed into the impact breakable container, and the outer peripheral surface of the impact breakable container has angulated portions on which stress caused by impact is concentrated.

5. Fire-extinguishing equipment as claimed in claim 1, wherein the fire-extinguishing liquid agent is obtained by mixing the first fire-extinguishing liquid agent with a surfactant solution obtained by dissolving a surfactant in hot water which is treated by passing through a magnetic field having a magnetic flux density of 3,000 to 10,000 G and has a temperature of 30° C. to 50° C.

6. Fire-extinguishing equipment as claimed in claim 2, wherein the fire-extinguishing liquid agent is obtained by mixing the second fire-extinguishing liquid agent with a surfactant solution obtained by dissolving a surfactant in hot water which is treated by passing through a magnetic field having a magnetic flux density of 3,000 to 10,000 G and has a temperature of 30° C. to 50° C.

7. Fire-extinguishing equipment as claimed in claim 3, wherein the fire-extinguishing liquid agent is obtained by mixing the third fire-extinguishing liquid agent with a surfactant solution obtained by dissolving a surfactant in hot water which is treated by passing through a magnetic field having a magnetic flux density of 3,000 to 10,000 G and has a temperature of 30° C. to 50° C.

8. Fire-extinguishing equipment as claimed in claim 4, wherein the fire-extinguishing liquid agent is obtained by mixing the fourth fire-extinguishing liquid agent with a surfactant solution obtained by dissolving a surfactant in hot water which is treated by passing through a magnetic field having a magnetic flux density of 3,000 to 10,000 G and has a temperature of 30° C. to 50° C.

9. Fire-extinguishing equipment as claimed in claim 5, wherein the surfactant according is obtained by mixing together one or more surfactants selected from sodium polyoxyethylene alkyl ether sulfate, sodium lauryl sulfate, and a polyoxyethylene lauryl ether salt.

10. Fire-extinguishing equipment as claimed in claim 5, wherein the surfactant according is obtained by mixing together one or more surfactants selected from a sodium salt of a β-naphthalenesulfonic acid formalin condensate, a special polycarboxylic acid-type polymer surfactant, and a polyoxyethylene lauryl ether salt.

11. Fire-extinguishing equipment as claimed in claim 6, wherein the surfactant according is obtained by mixing together one or more surfactants selected from sodium polyoxyethylene alkyl ether sulfate, sodium lauryl sulfate, and a polyoxyethylene lauryl ether salt.

12. Fire-extinguishing equipment as claimed in claim 7, wherein the surfactant according is obtained by mixing together one or more surfactants selected from sodium polyoxyethylene alkyl ether sulfate, sodium lauryl sulfate, and a polyoxyethylene lauryl ether salt.

13. Fire-extinguishing equipment as claimed in claim 8, wherein the surfactant according is obtained by mixing together one or more surfactants selected from sodium polyoxyethylene alkyl ether sulfate, sodium lauryl sulfate, and a polyoxyethylene lauryl ether salt.

14. Fire-extinguishing equipment as claimed in claim 6, wherein the surfactant according is obtained by mixing together one or more surfactants selected from a sodium salt of a β-naphthalenesulfonic acid formalin condensate, a special polycarboxylic acid-type polymer surfactant, and a polyoxyethylene lauryl ether salt.

15. Fire-extinguishing equipment as claimed in claim 7, wherein the surfactant according is obtained by mixing together one or more surfactants selected from a sodium salt of a β-naphthalenesulfonic acid formalin condensate, a special polycarboxylic acid-type polymer surfactant, and a polyoxyethylene lauryl ether salt.

16. Fire-extinguishing equipment as claimed in claim 8, wherein the surfactant according is obtained by mixing together one or more surfactants selected from a sodium salt of a β-naphthalenesulfonic acid formalin condensate, a special polycarboxylic acid-type polymer surfactant, and a polyoxyethylene lauryl ether salt.

* * * * *